US007116190B2

(12) United States Patent
Brunker et al.

(10) Patent No.: US 7,116,190 B2
(45) Date of Patent: Oct. 3, 2006

(54) SLOT TRANSMISSION LINE PATCH CONNECTOR

(75) Inventors: David L. Brunker, Naperville, IL (US); Richard A. Nelson, Geneva, IL (US); Philip J. Dambach, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 74 days.

(21) Appl. No.: 11/023,880

(22) Filed: Dec. 23, 2004

(65) Prior Publication Data

US 2005/0168303 A1 Aug. 4, 2005

Related U.S. Application Data

(60) Provisional application No. 60/571,010, filed on May 14, 2004, provisional application No. 60/532,716, filed on Dec. 24, 2003.

(51) Int. Cl.
*H01P 1/04* (2006.01)

(52) U.S. Cl. ..... 333/260; 333/245; 333/1

(58) Field of Classification Search ..... 333/1, 333/246, 245, 260
See application file for complete search history.

(56) References Cited

U.S. PATENT DOCUMENTS 5,468,918 A 11/1995 Kanno et al.
2003/0179050 A1* 9/2003 Brunker et al. ..... 333/4
2005/0151597 A1 7/2005 Brunker et al.
2005/0151604 A1 7/2005 Brunker et al.
2005/0156690 A1 7/2005 Brunker et al.
2005/0174191 A1 8/2005 Brunker et al.
2005/0201065 A1 9/2005 Regnier et al.
2005/0202722 A1 9/2005 Regnier et al.
2006/0139117 A1 6/2006 Brunker et al.

* cited by examiner

*Primary Examiner*—Stephen E. Jones
(74) *Attorney, Agent, or Firm*—Thomas D. Paulius

(57) ABSTRACT

A slot transmission line patch connector, capable of bridging one or more slot transmission lines is comprised of an elongated dielectric connector body. The dielectric connector body is formed to have one or more slot transmission lines. Each transmission line formed in the dielectric body has first and second ends, each of which mates with corresponding first and second slot transmission lines. Alternate embodiments contemplate a dielectric body to which is attached one or more slot transmission line substrates, each of which supports one or more slot transmission lines. Each of the slot transmission line substrates provide one or more slot transmission lines that each bridge or "patch" together two, separate slot transmission lines together.

14 Claims, 21 Drawing Sheets

SLOT TRANSMISSION LINE PATCH CONNECTOR

REFERENCE TO RELATED APPLICATIONS

This application claims priority from prior U.S. Patent Application Nos. 60/571,010, filed May 14, 2004 and 60/532,716, filed Dec. 24, 2003.

BACKGROUND OF THE INVENTION

The present invention pertains to multi-circuit electronic communication systems, and more particularly, to a dedicated transmission channel structure for use in such systems.

Various means of electronic transmission are known in the art. Most, if not all of these transmission means, suffer from inherent speed limitations such as both the upper frequency limit and the actual time a signal requires to move from one point to another within the system, which is commonly referred to as propagation delay. They simply are limited in their electronic performance primarily by their structure, and secondarily by their material composition. One traditional approach utilizes conductive pins, such as those found in an edge card connector as is illustrated in FIG. 1. In this type of structure a plurality of conductive pins, or terminals 20, are arranged within a plastic housing 21 and this arrangement provides operational speeds of about 800 to 900 MHz. An improvement upon this standard structure is represented by edge card connectors that may be known in the art as "Hi-Spec" and which are illustrated in FIG. 2, in which the system includes large ground contacts 25 and small signal contacts 26 disposed within an insulative connector housing 27. The smaller signal contacts 26 couple to the larger ground contacts 25. The signal contacts in these structures are not differential signal contacts, but are merely single-ended signal, meaning that every signal contact is flanked by a ground contact. The operational speeds for this type of system are believed to be about 2.3 Ghz.

Yet another improvement in this field is referred to as a "triad" or "triple" connector in which conductive terminals are disposed within a plastic housing 28 in a triangular pattern, and the terminals include a large ground terminal 29, and two smaller differential signal terminals 30, as illustrated in FIG. 3, and, as described in greater detail U.S. Pat. No. 6,280,209. This triad/triple structure has an apparent upper limit speed of about 4 Ghz. All three of these approaches utilize, in the simplest sense, conductive pins in a plastic housing in order to provide a transmission line for electronic signals.

In each of these type constructions, it is desired to maintain a dedicated transmission line through the entire delivery path of the system, including through the circuit board(s), the mating interface and the source and load of the system. It is difficult to achieve the desired uniformity within the system when the transmission system is constructed from individual pins. Discrete point-to-point connections are used in these connectors for signal, ground and power. Each of these conductors was designed as either a conductor or a means of providing electrical continuity and usually did not take into account transmission line effects. Most of the conductors were designed as a standard pinfield so that all the pins, or terminals, were identical, regardless of their designated electrical function and the pins were further arranged at a standard pitch, material type and length. Although satisfactory in performance at low operating speeds, at high operational speeds, these systems would consider the conductors as discontinuities in the system that affect the operation and speed thereof Many signal terminals or pins in these systems were connected to the same ground return conductor, and thus created a high signal to ground ratio, which did not lend themselves to high-speed signal transmission because large current loops are forced between the signals and the ground, which current loops reduce the bandwidth and increase the cross talk of the system, thereby possibly degrading the system performance.

Bandwidth ("BW") is proportional to $1/\sqrt{(LC)}$, where L is the inductance of the system components, C is the capacitance of the system components and BW is the bandwidth. The inductive and capacitive components of the signal delivery system work to reduce the bandwidth of the system, even in totally homogeneous systems without discontinuities. These inductive and capacitive components can be minimized by reducing the overall path length through the system, primarily through limiting the area of the current path through the system and reducing the total plate area of the system elements. However, as the transmission frequency increases, the reduction in size creates its own problem in that the effective physical length is reduced to rather small sizes. High frequencies in the 10 Ghz range and above render most of the calculated system path lengths unacceptable.

In addition to aggregate inductance and capacitance across the system being limiting performance factors, any non-homogeneous geometrical and/or material transitions create discontinuities. Using about 3.5 Ghz as a minimum cutoff frequency in a low voltage differential signal system operating at around 12.5 Gigabits per second (Gbps), the use of a dielectric with a dielectric constant of about 3.8 will yield a critical path length of about 0.25 inches, over which length discontinuities may be tolerated. This dimension renders impracticable the ability of one to construct a system that includes a source, transmission load and load within the given quarter-inch. It can thus be seen that the evolution of electronic transmission structures have progressed from uniform-structured pin arrangements to functionally dedicated pins arrangements to attempted unitary structured interfaces, yet the path length and other factors still limit these structures. With the aforementioned prior art structures, it was not feasible to carry high frequency signals due to the physical restraints of these systems and the short critical path lengths needed for such transmission.

In order to obtain an effective structure, one must maintain a constant and dedicated transmission line over the entire delivery path: from the source, through the interface and to the load. This would include the matable interconnects and printed circuit boards but it also includes bridging a transmission line over components as well as bridging a transmission line over a circuit board trace. This is very difficult to achieve when the delivery system is constructed from individual, conductive pins designed to interconnect with other individual conductive pins because of potential required changes in the size, shape and position of the pins/terminals with respect to each other. For example, in a right angle connector, the relationship between the rows of pins/terminals change in both the length and the electrical coupling. High speed interconnect design principles that include all areas between the source and load of the system including printed circuit boards, board connectors and cable assemblies are being used in transmission systems with sources of up to 2.5 Gbps. One such principle is the principle of ground by design, which provides added performance over a standard pin field in that coupling is enhanced between the signal and ground paths and single-ended operation is complimented. Another principle being used in such systems includes impedance tuning to minimize discontinuities. Yet another design principle is pinout optimization where signal and return paths are assigned to specific pins in the pin field to maximize the performance. These type of systems all are limited with respect to attaining the critical path lengths mentioned above.

The present invention is directed to an improved transmission or delivery system that overcomes the aforementioned disadvantages and which operates at higher speeds.

SUMMARY OF THE INVENTION

The present directed is therefore directed to an improved transmission structure that overcomes the aforementioned disadvantages and utilizes grouped electrically conductive elements to form a unitary mechanical structure that provides a complete electronic transmission channel that is similar in one sense to a fiber optic system. The focus of the invention is on providing a complete, copper-based electronic transmission channel rather than utilizing either individual conductive pins or separable interfaces with copper conductors as the transmission channel, the transmission channels of the invention yielding more predictable electrical performance and greater control of operational characteristics. Such improved systems of the present invention are believed to offer operating speeds for digital signal transmission of up to at least 12.5 GHz at extended path lengths which are much greater than 0.25 inch.

Accordingly, it is a general object of the present invention to provide an engineered waveguide that functions as a grouped element channel link, where the link includes an elongated dielectric body portion and at least two conductive elements disposed along the exterior surface thereof.

Another object of the present invention is to provide a high-speed channel link (or transmission line) having an elongated body portion of a given cross-section, the body portion being formed from a dielectric with a selected dielectric constant, and the link having, in its most basic structure, two conductive elements disposed on the exterior surface thereof, the elements being of similar size and shape and oriented thereon, in opposition to each other, so as to steer the electrical energy wave traveling through the link by establishing particular electrical and magnetic fields between the two conductive elements and maintaining these fields throughout the length of the channel link.

A further object of the present invention is to control the impedance of the channel link by selectively sizing the conductive elements and the gaps therebetween on the exterior surface of the elongated body to maintain balanced or unbalanced electrical & magnetic fields.

Yet another object of the present invention is to provide a improved electrical transmission channel that includes a flat substrate, and a plurality of grooves formed in the substrate, the grooves having opposing sidewalls and the grooves being spaced apart by intervening lands of the substrate, the sidewalls of the grooves having a conductive material deposited thereon, such as by plating or deposition, to form electronic transmission channels within the grooves.

A still further object of the present invention is to provide a pre-engineered wave guide in which at least a pair of conductive elements are utilized to provide differential signal transmission, i.e., signal in ("+") and signal out ("−"), the pair of conductive elements being disposed on the exterior of the dielectric body so as to permit the establishment of capacitance per unit length, inductance per unit length, impedance, attenuation and propagation delay per unit length, and establishing these pre-determined performance parameters within the channels formed by the conductive elements.

A yet further object of the present invention is to provide an improved transmission line in the form of a solid link, of preferably uniform, circular cross-section, the link including at least a pair of conductive elements disposed thereon that serve to guide the electrical wave therethrough, the link including at least one thin filament of dielectric material having two conductive surfaces disposed thereon, the conductive surfaces extending lengthwise of the filament and separated by two circumferential arcuate extents, the conductive surfaces further being separated from each other to form a discrete, two-element transmission channel that reduces the current loop and in which the signal conductors are more tightly aligned.

Yet another object of the present invention is to provide a non-circular transmission line for high speed applications, which includes an elongated rectangular or square dielectric member having an exterior surface with at least four distinct sectors disposed thereon, the dielectric member including a pair of conductive elements aligned with each other and disposed on two of the sectors, while separated by an intervening sector.

The present invention accomplishes the above and other objects by virtue of its unique structure. In one principal aspect, the present invention includes a transmission line that is formed from a dielectric, through which conductors are spaced and arranged to conform to the aforementioned triangular conductor pattern of a "triad" connector. The triangular "triad" conductor pattern is accomplished by spacing the electrodes using a slot is cut or formed through dielectric. At the top edge of each side of the slot and just outside the slot, a thin, narrow strip of conductive material is deposited on each side of the slot. A thin strip of conductive material is deposited at the bottom of the slot. By sizing the depth and width of the slot, the transmission line conductors along the slot's top edges and the bottom can be precisely matched to the triangular spacing used in virtually any "triad" conductor. By matching the transmission line's conductor's to a "triad" connector, impedance discontinuities at a "triad" connector/transmission line interface can be reduced or eliminated.

In another aspect of the invention, two separate sections of slot transmission line can be connected together or "bridged" by way of a patch connector that couples to the opposing conductors of one slot transmission line segment, to the opposing conductors of a second slot transmission line segment. The sizing and spacing of conductors in the patch connector match the sizing and spacing of conductors of two or more transmission lines that are to be coupled together thereby minimizing wave reflections on the transmission line that are caused by discontinuities along the line.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which:

FIG. 5 is a schematic end view of the grouped element channel link of FIG. 4 illustrating the arcuate extents of the conductive elements and the spacing there between;

FIG. 30 is a sectional view of the substrate shown in FIG. 29 depicting a non-air dielectric filling the slot, the bottom of which is metallized;

FIG. 31 is a perspective view of an alternate embodiment of a patch connector constructed in accordance with the principles of the present invention;

DETAILED DESCRIPTION OF THE PREFERRED EMBODIMENTS

Figure 1:
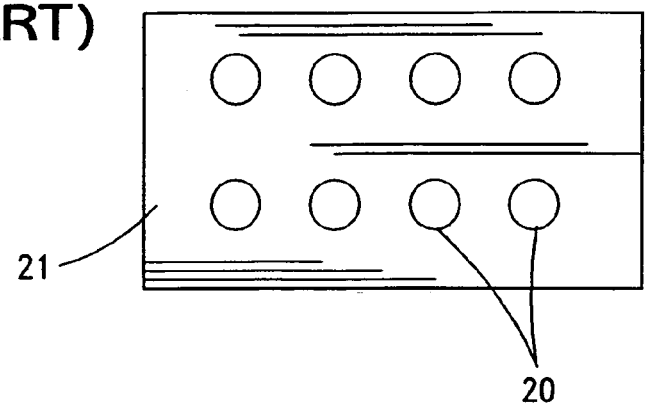
FIG. 1 (PRIOR ART)
FIG. 1 is a schematic plan view of the terminating face of a conventional connector.
Figure 2:
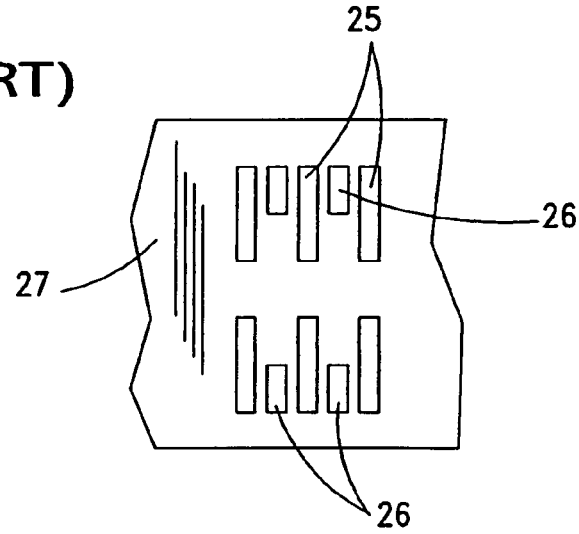
FIG. 2 (PRIOR ART)
FIG. 2 is a schematic plan view of an edge card used in a high speed connector.
Figure 3:
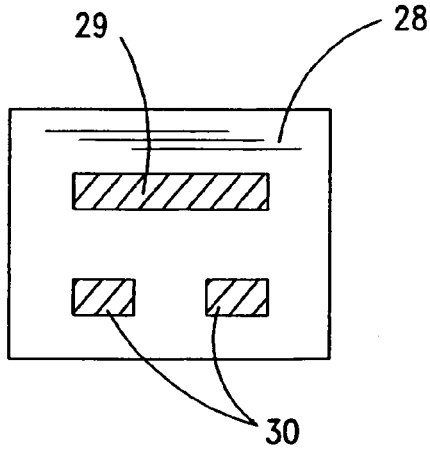
FIG. 3 (PRIOR ART)
FIG. 3 is a schematic elevational view of a high speed connector utilizing a triad or triple.
Figure 4:
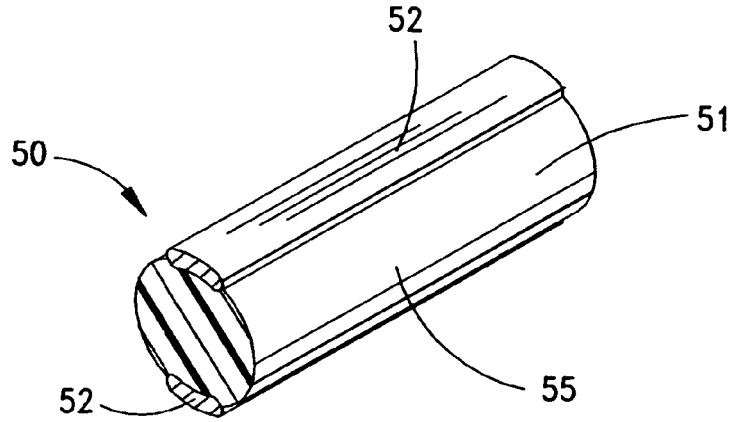
FIG. 4 is a perspective view of a grouped element channel link constructed in accordance with the principles of the present invention.
Figure 5:
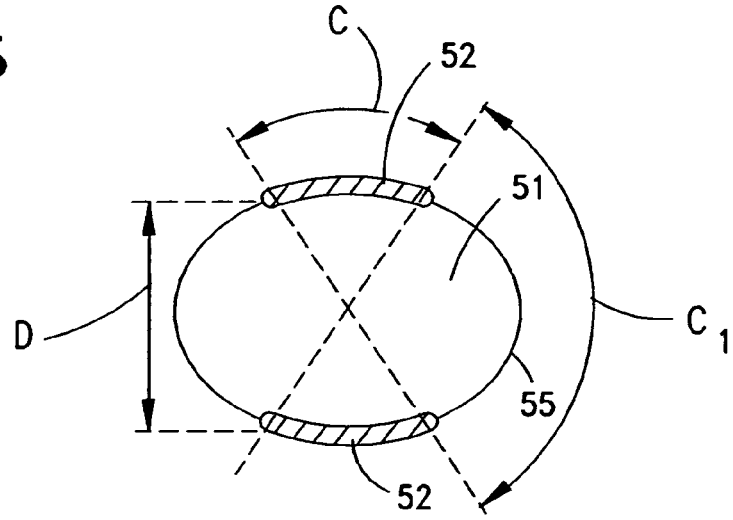

FIG. 4 illustrates a grouped element channel link 50 constructed in accordance with the principles of the present invention. It can be seen that the link 50 includes an elongated, dielectric body 51, preferably a cylindrical filament, that is similar to a length of fiber optic material. It differs therefrom in that the link 50 acts as a pre-engineered wave guide and a dedicated transmission media. In this regard, the body 51 is formed of a dedicated dielectric having a specific dielectric constant and a plurality of conductive elements 52 applied thereto. In FIGS. 4 and 5, the conductive elements 52 are illustrated as elongated extents, traces or strips, 52 of conductive material and, as such, they may be traditional copper or precious metal extents having a definite cross-section that may be molded or otherwise attached, such as by adhesive or other means to the dielectric body of the link 50. They may also be formed on the exterior surface 55 of the body 51 such as by a suitable plating or vacuum deposition process. The conductive traces 52 are disposed on the exterior surface and have a width that extends along the perimeter of the dielectric body.

Figure 29:
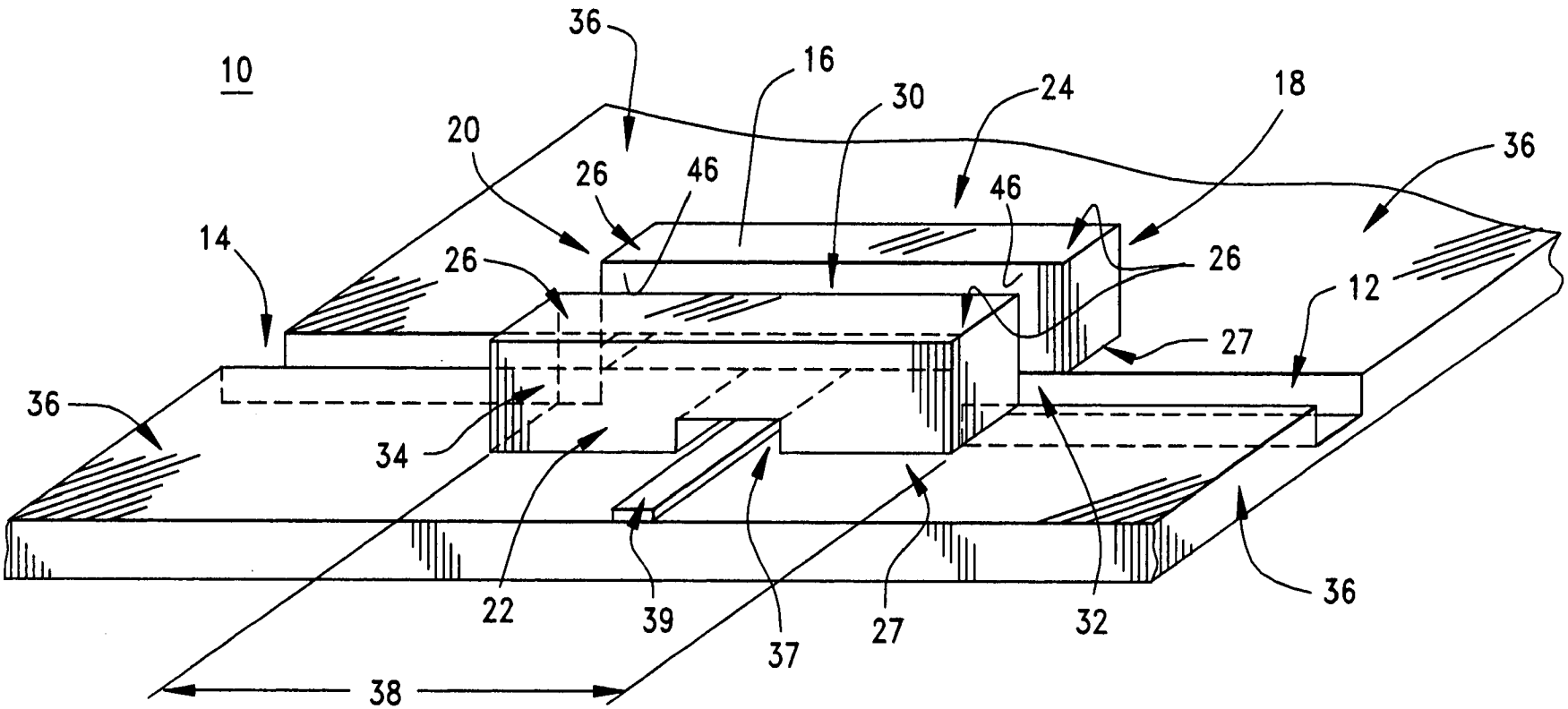
FIG. 29 is a perspective view of a planar triad slot transmission line in a dielectric substrate.

At least two such conductors are used on each link, typically are used for signal conveyance of differential signals, such as +0.5 volts and −0.5 volts. The use of such a differential signal arrangement permits us to characterize structures of this invention as pre-engineered waveguides that are maintained over substantially the entire length of the signal delivery path. The use of the dielectric body 51 provides for preferred coupling to occur within the link. In the simplest embodiment, as illustrated in FIG. 5, the conductive elements are disposed on two opposing faces, so that the electrical affinity of each of the conductive elements is for each other through the dielectric body upon which they are supported, or in the case of a conductive channel as will be explained in greater detail to follow and as illustrated in FIGS. 29–30, the conductive elements are disposed on two or more interior faces of the cavity/cavities to establish the primary coupling mode across the cavity gap and through an air dielectric. In this manner, the links of the present invention may be considered as the electrical equivalent to a fiber optic channel or extent.

The present invention is directed to electrical waveguides. The waveguides of the present invention are intended to maintain electrical signals at desired levels of electrical affinity at high frequencies from about 1.0 Ghz to at least 12.5 Ghz and preferably higher. Optical waveguides, as described in U.S. Pat. No. 6,377,741, issued Apr. 23, 2002, typically rely upon a single outer coating, or cladding, having mirror-like reflective properties to maintain the light particles moving in a selected direction. Openings in the outer coating/cladding will result in a dispersal of the light traveling through the waveguide, which adversely affects the light beam of the waveguide. Microwave waveguides are used at very high frequencies to direct the energy of the microwave beam, rather than transmit it as exemplified by U.S. Pat. No. 6,114,677, issued Sep. 5, 2002 in which a microwave waveguide is used to direct the microwaves at the center portion of an oven. Such a directional aim is also utilized the microwave antenna art. In each instance, these type of waveguides are used to focus and direct the energy of the light of microwave traveling through them, whereas in the present invention, the entire waveguide structure is engineered to maintain an electrical signal at desired frequency(ies) and impedance, capacitance and inductance.

The effectiveness of the links of the present invention are dependent upon the guiding and maintenance of digital signals through the channel link, by utilizing two or more conductive surfaces of electrical containment. This will include maintaining the integrity of the signal, controlling the emissions and minimizing loss through the link. The channel links of the present invention contain the electromagnetic fields of the signals transmitted therethrough by controlling the material of the channel link and the geometries of the system components so that preferred field coupling will be provided. Simply stated, the present invention creates an engineered transmission line by defining a region of electrical affinity, i.e., the dielectric body 51, that is bounded by conductors, i.e., conductive surfaces 52, of opposing charge, i.e., negative and positive differential signals.

As illustrated better in FIG. 5, the two conductive surfaces 52 are arranged on the dielectric body 51 in opposition to each other. The dielectric body 51 shown in FIG. 4 takes the form of a cylindrical rod, while the dielectric body shown in FIG. 5 has an oval-like configuration. In each such instance, the conductive surfaces or traces 52, extend for distinct arc lengths. Both FIGS. 4 and 5 are representative of a "balanced" link of the invention where the circumferential extent, or arc length C of the two conductive surfaces 52 is the same, and the circumferential extents or arc lengths C1 of the non-conductive exterior surfaces 55 of the dielectric body 51 are also the same. This length may be considered to define a gross separation D between the conductive surfaces. As will be explained below, the link may be "unbalanced" with one of the conductive surfaces having an arc length that is greater than the other, and in such an instance, the transmission line is best suited for single-ended, or non-differential signal applications. In instances where the dielectric body and link are circular, the link may serve as a contact pin and so be utilized in connector applications. This circular cross-section demonstrates the same type of construction as a conventional round contact pin.

Figure 6:
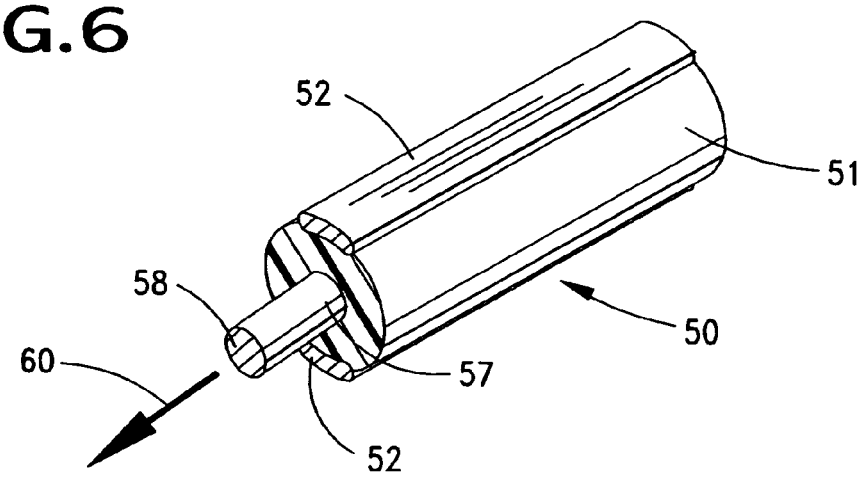
FIG. 6 is a perspective view of an alternate embodiment of a grouped element channel link constructed in accordance with the principles of the present invention.

As illustrated in FIG. 6, the links of the present invention may be modified to provide not only multiple conductive elements as part of the overall system transmission media, but may also incorporate a coincident and coaxial fiber optic wave guide therewithin for the transmission of light and optical signals. In this regard, the dielectric body 51 is cored to create a central opening 57 through which an optical fiber 58 extends. Electrical signals may be transmitted through this link as well as light signals 60.

Figure 7:
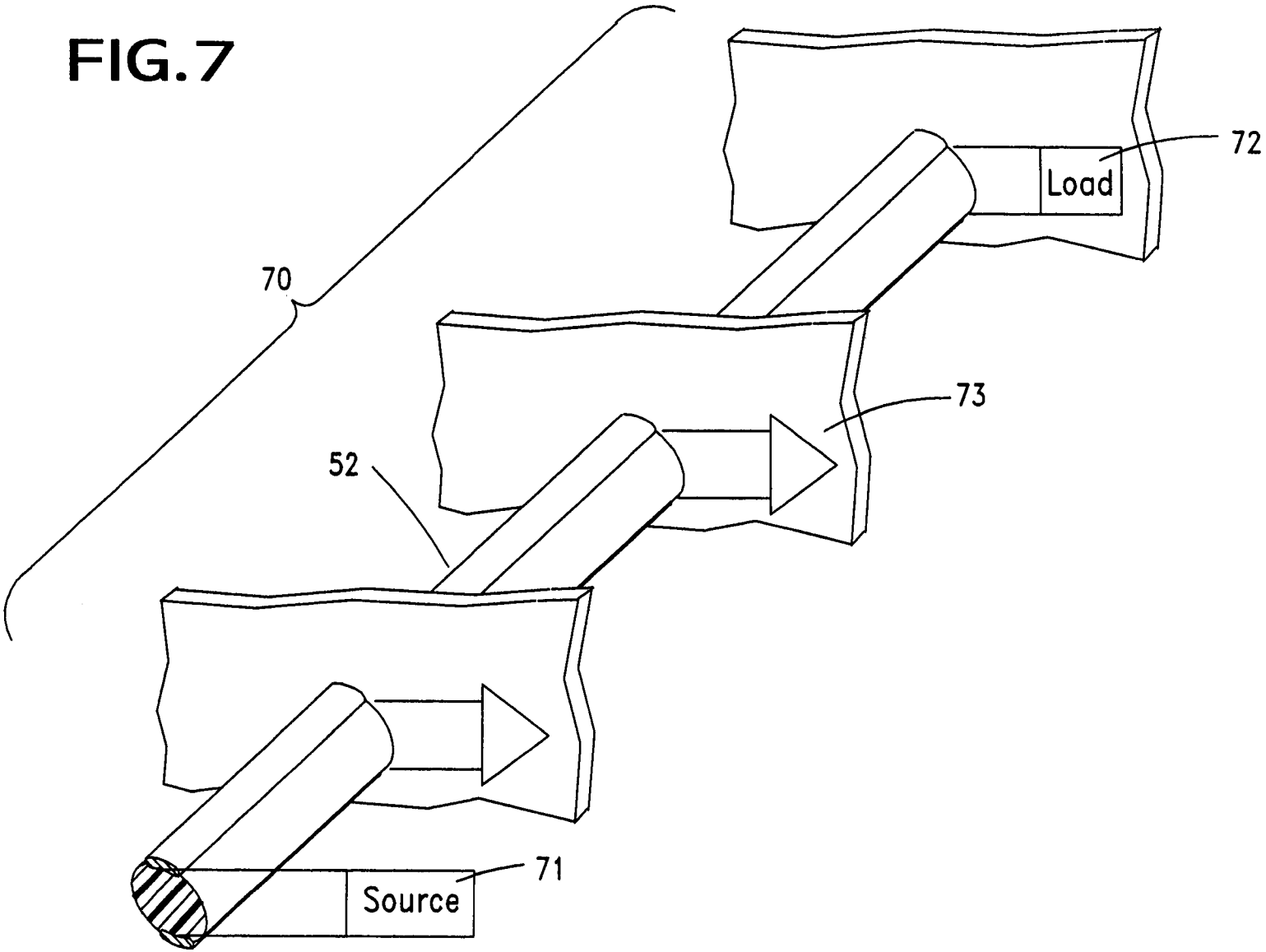
FIG. 7 is a schematic view of a transmission link of the present invention used to connect a source with a load having intermediate loads on the transmission link.

FIG. 7 schematically illustrates a transmission line 70 incorporating a link 50 of the present invention that extends between a source 71 and a load 72. The conductive surfaces 52 of the link serve to interconnect the source and load together, as well as other secondary loads 73 intermediate the source and the load. Such secondary loads may be added to the system to control the impedance through the system. A line impedance is established at the source and may be modified by adding secondary loads to the transmission line.

Figure 8:
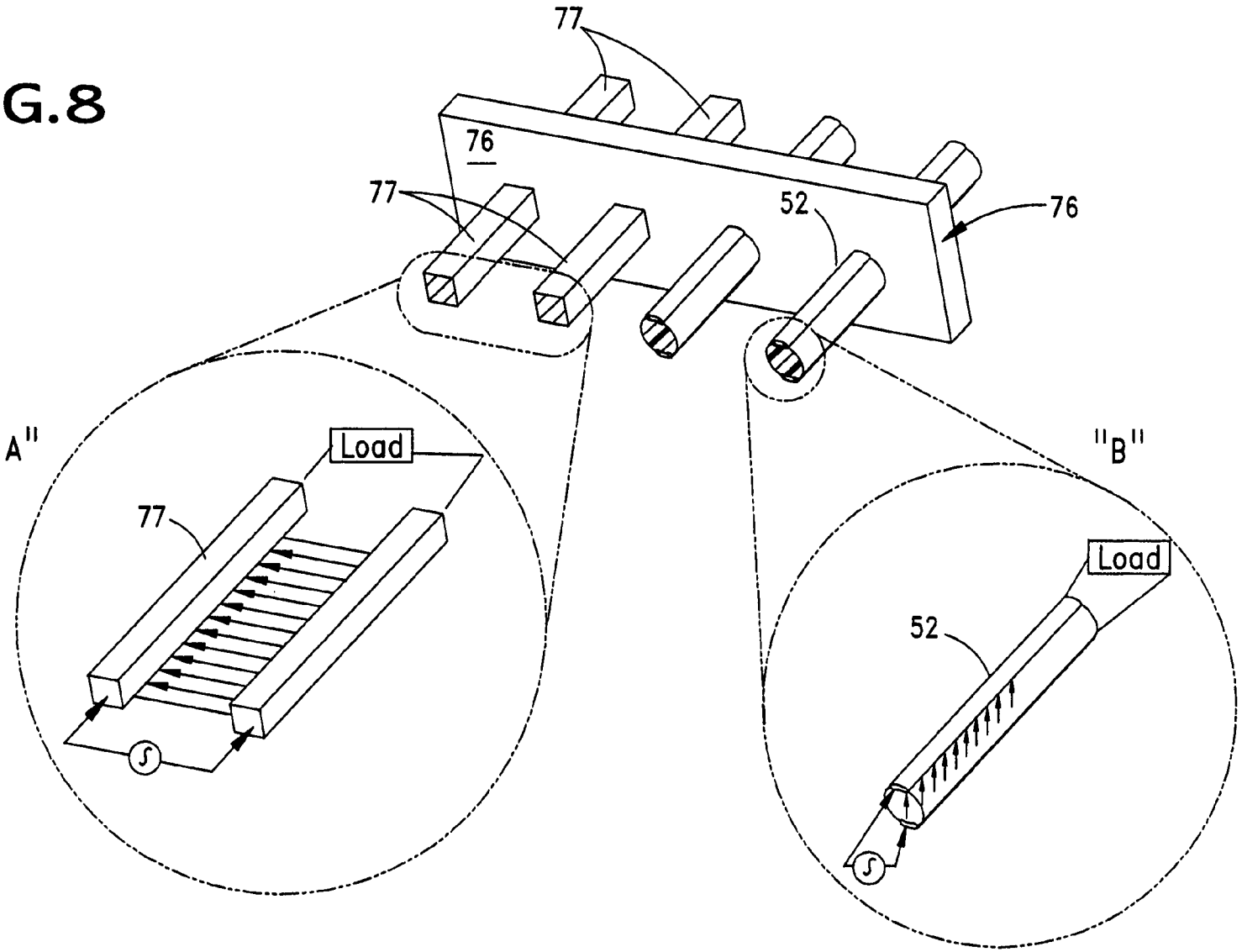
FIG. 8 is a schematic view of a connector element utilizing both conventional contacts "A" and the transmission links "B" of the invention, with enlarged detail portions at "A" and "B" thereof, illustrating the occurrence of inductance in the respective systems.
Figure 9:
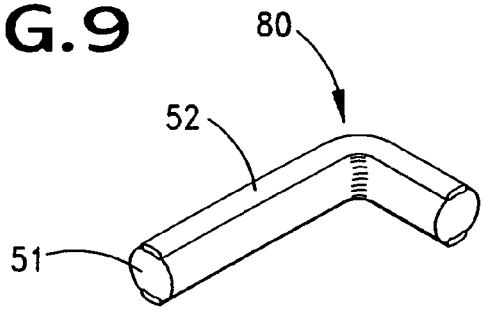
FIG. 9 is a perspective view of an alternate construction of a link of the invention with a right angle bend formed therein.
Figure 10:
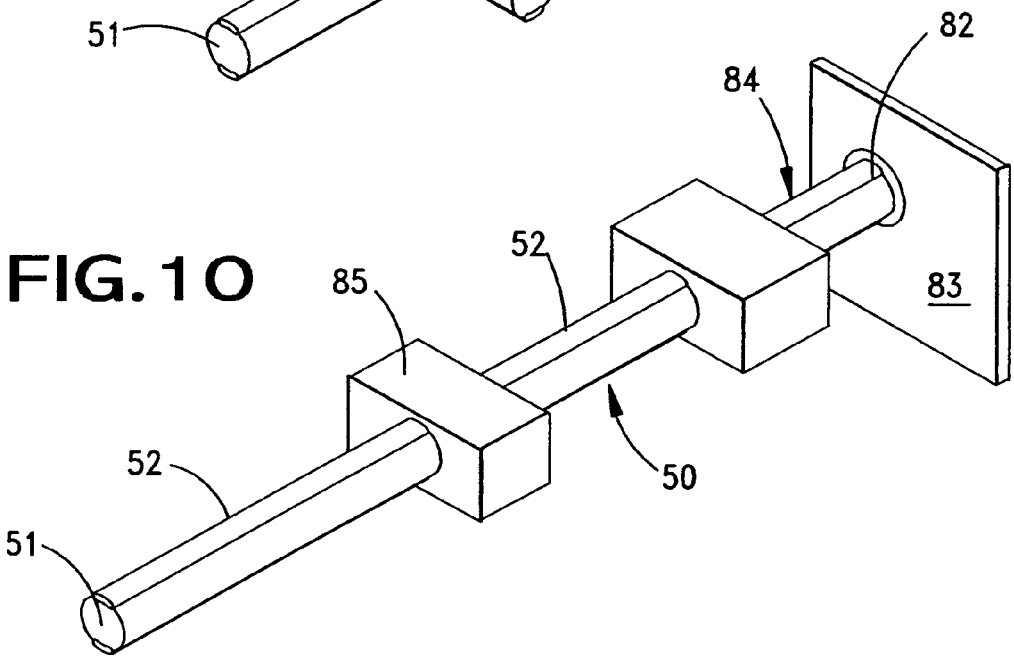
FIG. 10 is a schematic view of a transmission line utilizing the links of the present invention.

FIG. 8 illustrates, schematically, the difference between the links of the present invention and conventional conductors, which are both illustrated as supported by a dielectric block 76. Two discrete, conventional conductors 77 are formed from copper or another conductive material and extend through the block 76, in the manner of pins. As shown in enlargement "A", the two discrete conductor presents an open cell structure with a large inductance (L) because of the enlarged current loop. Quite differently, the links of the present invention have a smaller inductance (L) at a constant impedance due to the proximity of the conductive surfaces to each other as positioned as the dielectric body 51. The dimensions of these links 50 can be controlled in the manufacturing process and extrusion will be the preferred process of manufacturing with the conductive surfaces being extended with the dielectric body or separately applied of the extrusion, such as by a selective plating process so that the resulting construction is of the plated plastic variety. The volume of the dielectric body 51 and the spacing between conductive elements disposed thereon may be easily controlled such an extrusion process. The conductive surfaces preferably extend for the length of the dielectric body and may end slightly before the ends thereof at a location where it is desired to terminate the transmission line to a connector, circuit board or similar component, As FIG. 9 illustrates, the dielectric body may have a bend 80 forward therewith in the form of the 90. degree. right-angle bend illustrated or in any other angular orientation. As shown, the conductive surfaces 52 extend through the bend 80 with the same separation spacing between them and the same width with which the conductive surfaces start and end. The dielectric body 51 and the conductive surfaces 52 are easily maintained in their spacing and separation through the bend to eliminate any potential losses FIG. 10 illustrates a transmission line using the links of the invention. The link 50 is considered as a transmission cable formed from one or more single dielectric bodies 51, and one end 82 of it is terminated to a printed circuit board 83. This termination may be direct in order to minimize any discontinuity at the circuit board. A short transfer link 84 that maintains any discontinuities at a minimum is also provided. These links 84 maintain the grouped aspect of the transmission link. Termination interfaces 85 may be provided where the link is terminated to the connector with minimum geometry discontinuity or impedance discontinuity. In this manner, the grouping of the conductive surfaces is maintained over the length of the transmission line resulting in both geometric and electrical uniformity.

Figure 11:
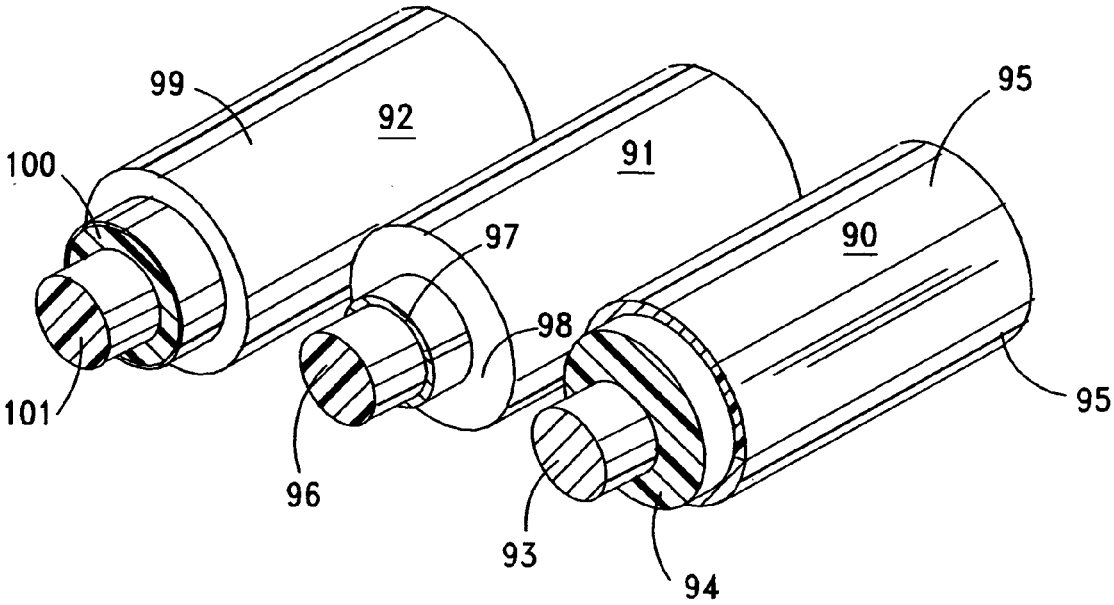
FIG. 11 is a perspective view illustrating alternate media compositions of the links of the invention.

FIG. 11 illustrates a variety of different cross-sections of the transmission links 50 of the invention. In the rightmost link 90, a central conductor 93 is encircled by a hollow dielectric body 94 which in turn, supports multiple conductive surfaces 95 that are separated by an intervening space, preferably filled with portions of the dielectric body 94. This construction is suitable for use in power applications where power is carried by the central conductor 93. In the middle link 91 of FIG. 11, the central cover 96 is preferably made of a selected dielectric and has conductive surfaces 97 supported on it. A protective outer insulative jacket 98 is preferably provided to protect and or insulate the inner link. The leftmost link 92 of FIG. 11 has a protective outer jacket 99 that encloses a plateable polymeric ring 100 that encircles either a conductive or insulative core 101. Portions 101 of the ring 100 are plated with a conductive material and are separated by unplated portions to define the two or more conductive surfaces desired on the body of the ring. Alternatively, one or the elements surrounding the core or of the link 92 may be filled with air and may be spaced away from an inner member by way of suitable standoffs or the like.

Figure 12:
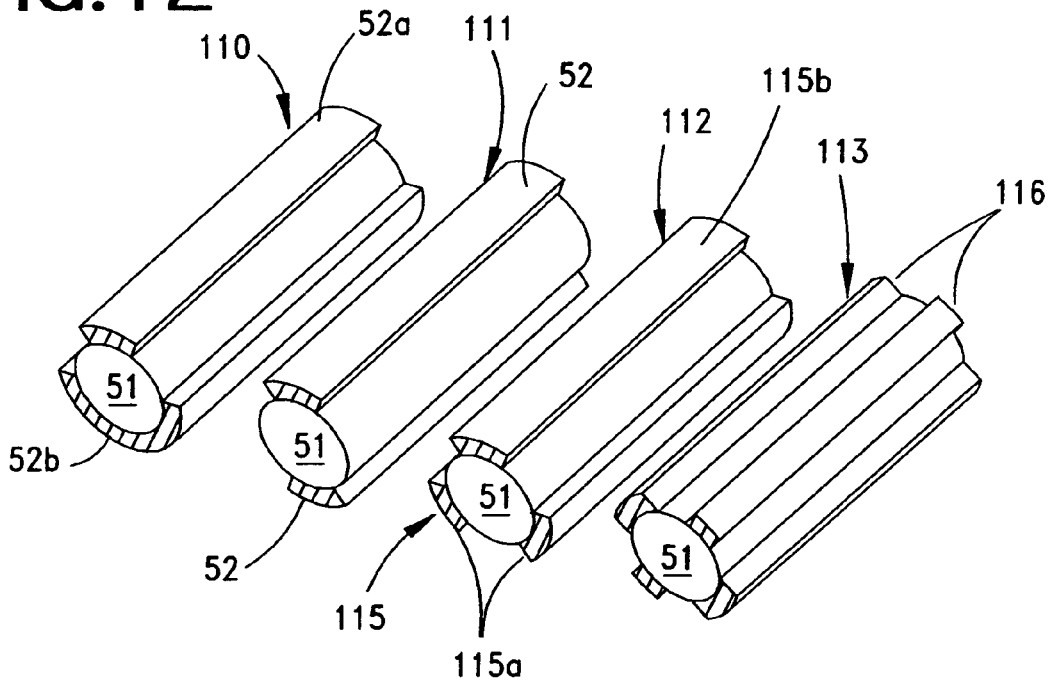
FIG. 12 is a perspective view of an array of different shapes of dielectric bodies illustrating alternate conductive surface arrangements.

FIG. 12 illustrates an array of links 110–113 that have their outer regions combined with the dielectric body 51 to form different types of transmission links. Link 10 has two conductive surfaces 52*a*, 52*b* of different arc lengths (i.e., unbalanced) disposed on the outer surface of the dielectric body 51 so that the link 110 may provide single-ended signal operation. Link 111 has two equal-spaced and sized (or "balanced") conductive elements 52 to provide an effective differential signal operation.

Link 112 has three conductive surfaces 115 to support two differential signal conductors 115*a* and an assorted ground conductor 115*b*. Link 113 has four conductive surfaces 116 disposed on its dielectric body 51 in which the conductive surfaces 116 may either include two differential signal channels (or pairs) or a single differential pair with a pair of associated grounds.

Figure 13:
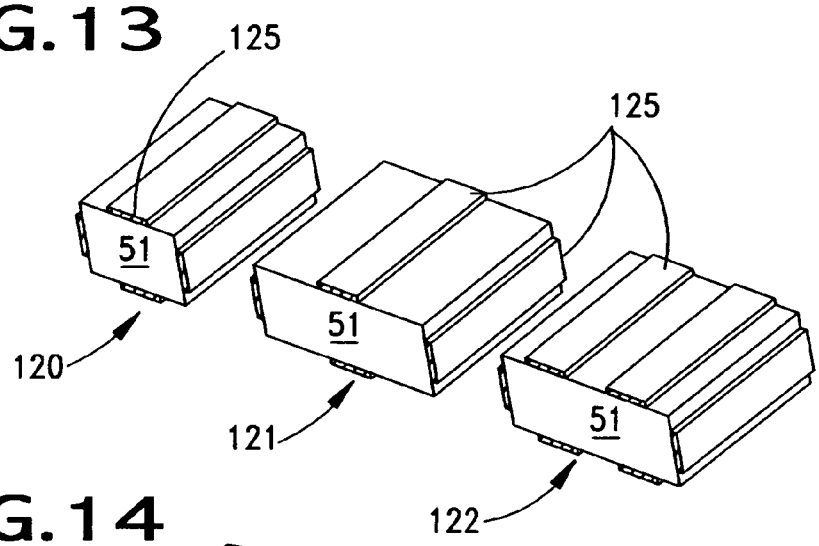
FIG. 13 is a perspective view of an array of non-circular cross-section dielectric bodies that may be used to form links of the invention.

FIG. 13 illustrates an array of one-type of non-circular links 120–122 that polygonal configurations, such as square configurations, as with link 120 or rectangular configurations as with links 121–122. The dielectric bodies 51 may be extruded with projecting land portions 125 that are plated or otherwise covered with conductive material. Individual conductive surfaces are disposed on individual sides of the dielectric body and preferably differential signal pairs of the conductive surfaces are arranged on opposing sides of the body. These land portions 125 may be used to "key" into connector slots of terminating connectors in a manner so that contact between the connector terminals (not shown) and the conductive faces 125 is easily effected.

Figure 14:
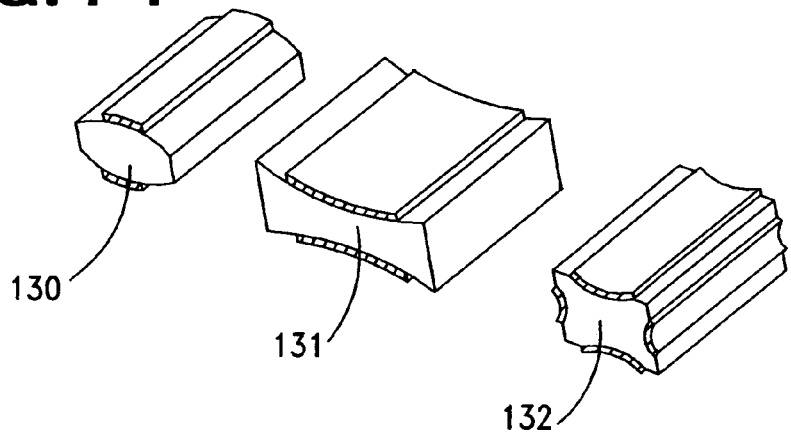
FIG. 14 is a perspective view of another array of non-circular cross-section dielectric bodies suitable for use as links of the invention.

FIG. 14 illustrates some additional dielectric bodies that may be utilized with the present invention. One body 130 is shown as convex, while the other two bodies 131, 132 are shown as being generally concave in configuration. A circular cross-section of the dielectric bodies has a tendency to concentrate the electrical field strength at the comers of the conductive surfaces, while a slightly convex form as shown in body 130, has a tendency to concentrate the field strength evenly, resulting in lower attenuation. The concave bodies, as illustrated by dielectric bodies 131, 132 may have beneficial crosstalk reduction aspects because it focuses the electrical field inwardly. The width or arc lengths of these conductive surfaces, as shown in FIG. 14 are less that the width or arc lengths of the respective body sides supporting them.

Importantly, the transmission link may be formed as a single extrusion 200 (FIGS. 15–16) carrying multiple signal channels thereupon, with each such channel including a pair of conductive surface 202–203. These conductive surfaces 202, 203 are separated from each other by the intervening dielectric body 204 that supports them, as well as web portions 205 that interconnect them together. This extrusion 200 may be used as part of an overall connector assembly 220, where the extrusion is received into a complementary shaped opening 210 formed in a connector housing 211. The inner walls of the openings 210 may be selectively plated, or contacts 212 may be inserted into the housing 211 to contact the conductive surfaces and provide, if necessary, surface mount or through hole tail portions.

Figure 17:
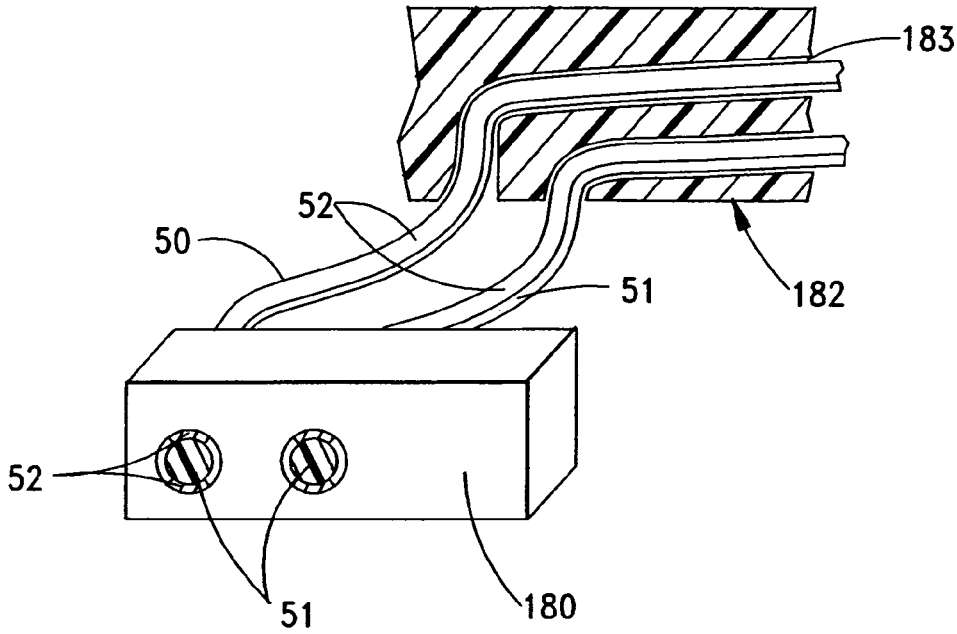
FIG. 17 is a diagrammatic view of a transmission channel of the present invention with two interconnecting blocks formed at opposite ends of the channel and illustrating the potential flexible nature of the invention.

FIG. 17 illustrates the arrangement of two transmission channels 50 arranged as illustrated and terminated at one end to a connector block 180 and passing through a right angle block 182 that includes a series of right angle passages 183 formed therein which receive the transmission channel links as shown. In arrangements such as that shown in FIG. 17, it will be understood that the transmission channel links may be fabricated in a continuous manufacturing process, such as by extrusion, and each such channel may be manufactured with intrinsic or integrated conductive elements 52. In the manufacturing of these elements, the geometry of the transmission channel itself may be controlled, as well as the spacing and positioning of the conductive elements upon the dielectric bodies so that the transmission channels will perform as consistent and unitary electronic waveguides which will support a single channel or "lane" of signal (communication) traffic. Because the dielectric bodies of the transmission channel links may be made rather flexible, the systems of the invention are readily conformable to various pathways over extended lengths without significantly sacrificing the electrical performance of the system. The one connector endblock 180 may maintain the transmission channels in a vertical alignment, while the block 182 may maintain the ends of the transmission channel links in a right angle orientation for termination to other components.

Figure 18:
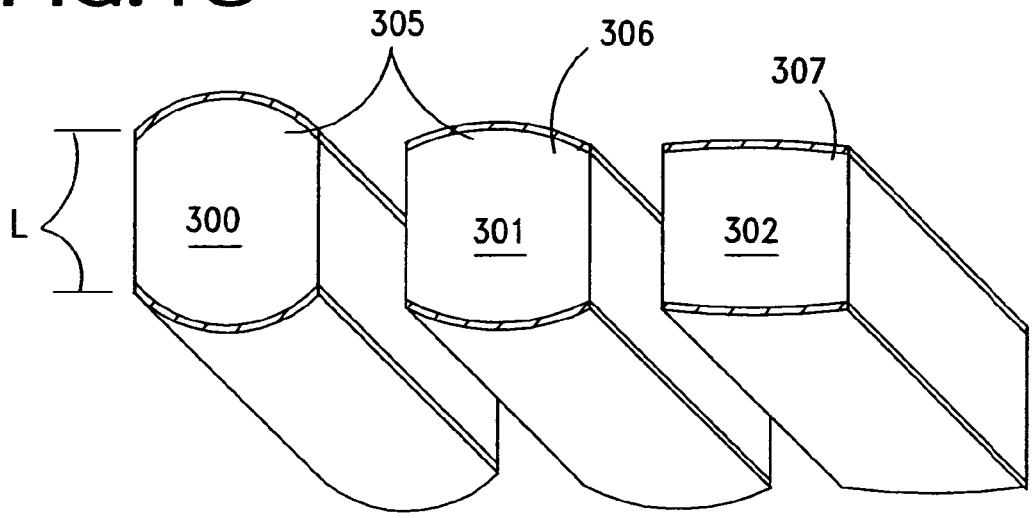
FIG. 18 is a perspective view of an array of differently configured dielectric bodies that may be used as links of the with different lens characteristics.

FIG. 18 illustrates a set of convex dielectric blocks or bodies 300–302 in which separation distance L varies and the curve 305 of the exterior surfaces 306 of the blocks rises among the links 300–302. In this manner, it should be understood that the shapes of the bodies may be chosen to provide different lens characteristics for focusing the electrical fields developed when the conductive elements are energized.

Figure 19:
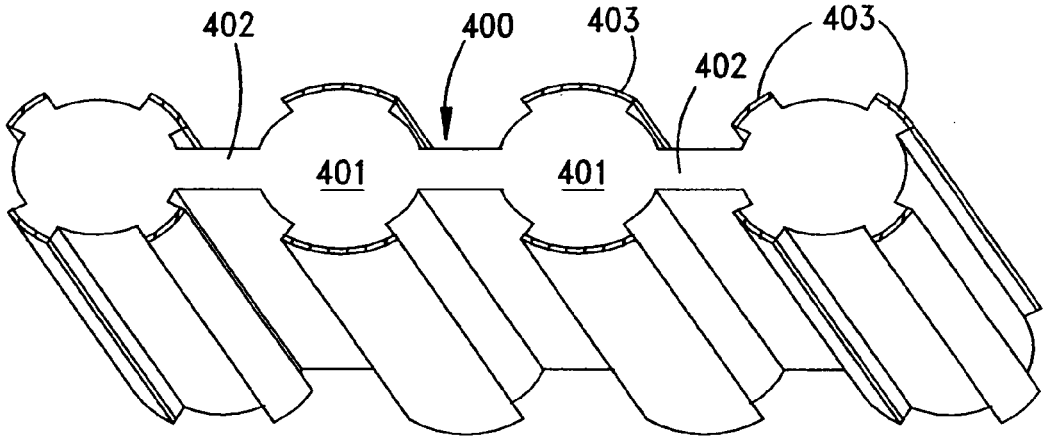
FIG. 19 is a perspective view of a multiple transmission link extrusion with different signal channels formed thereon.

FIG. 19 illustrates a multiple channel extrusion 400 with a series of dielectric bodies or blocks 401 interconnected by webs 402 in which the conductive surfaces 403 are multiple or complex in nature. As with the construction shown in FIG. 13, such an extrusion 400 supports multiple signal channels, with each of the channels preferably including a pair of differential signal conductive elements.

Figure 16:
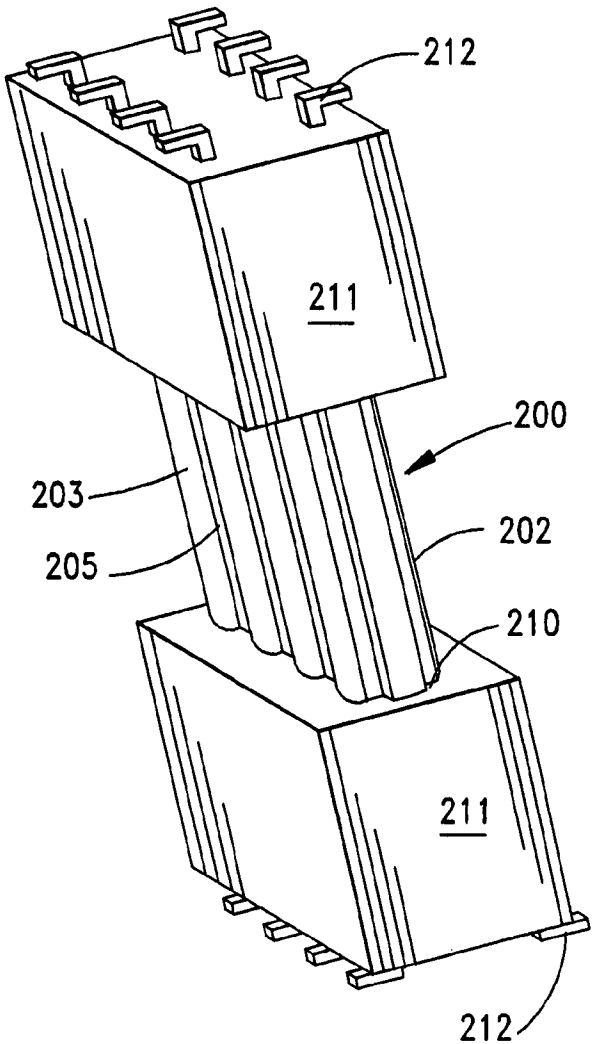
FIG. 16 is a perspective view of a connector assembly having two connector housings interconnected by the transmission link of FIG. 15.
Figure 15:
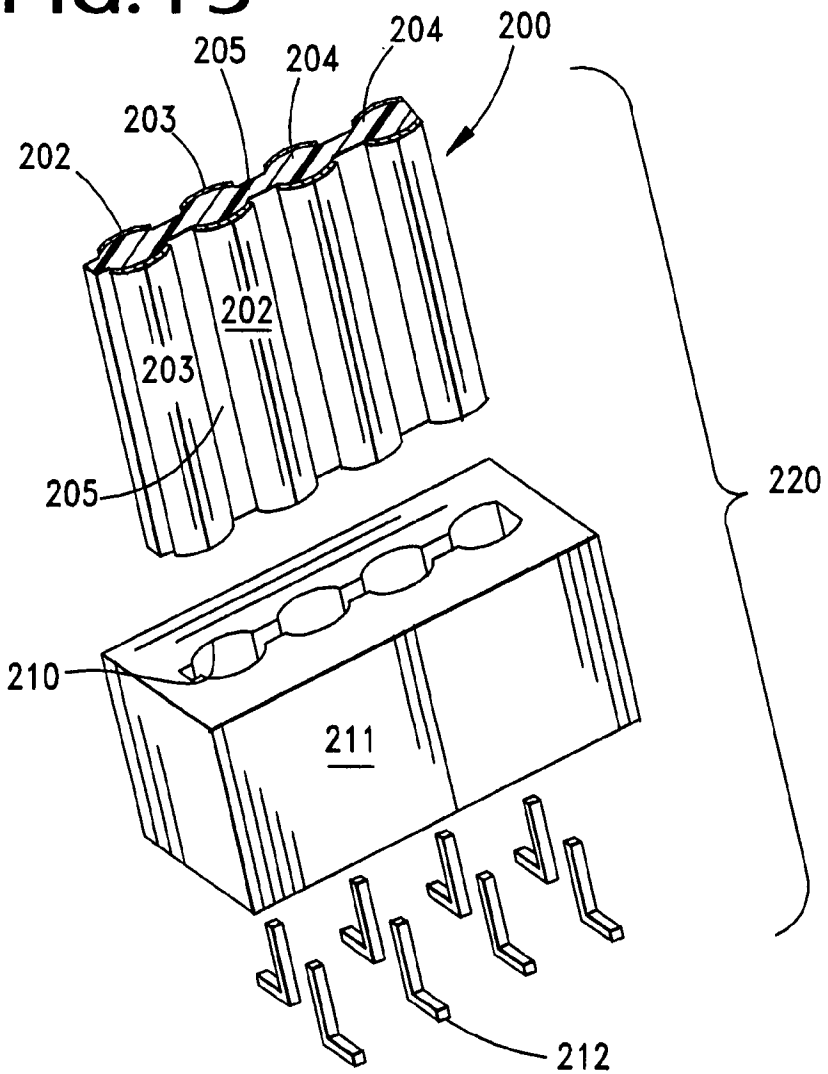
FIG. 15 is an exploded view of a connector assembly incorporating a multiple element link of the invention that is used to provide a transmission line between two connectors.
Figure 20:
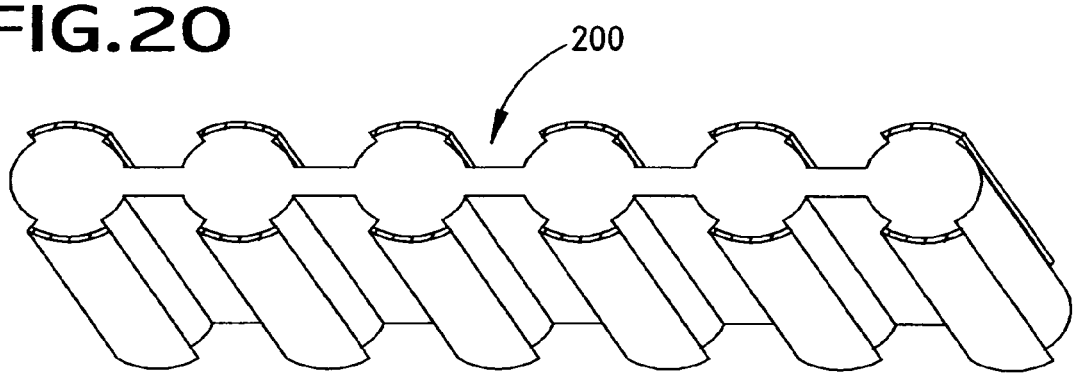
FIG. 20 is a perspective view of a multiple transmission-link extrusion used in the invention.
Figure 21:
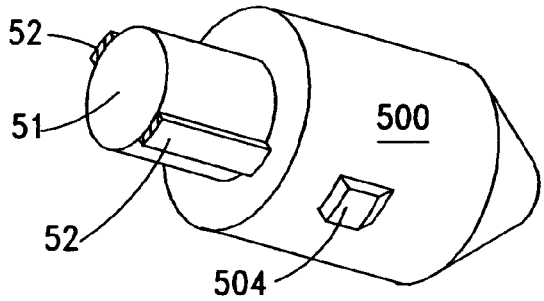
FIG. 21 is a perspective view of a mating interface used with a discrete transmission link of the invention, in which mating interface takes the form of a hollow endcap.
Figure 22:
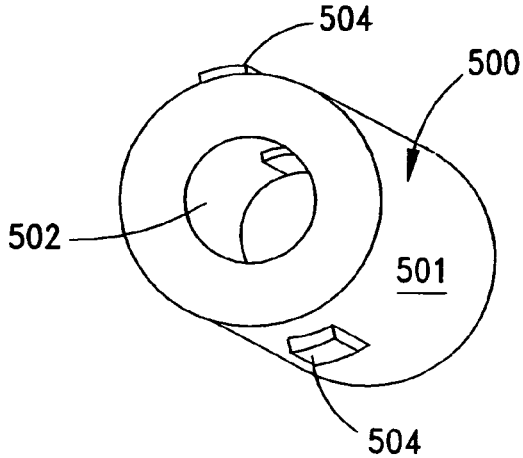
FIG. 22 is a rear perspective view of the endcap of FIG. 21, illustrating the center opening thereof that receives an end portion of the transmission link therein.
Figure 23:
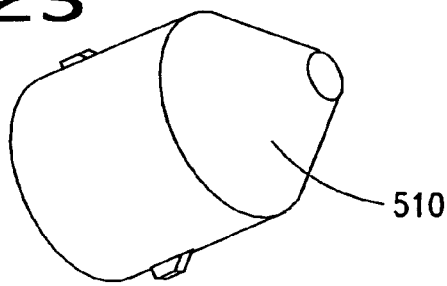
FIG. 23 is a frontal perspective view of the endcap of FIG. 21, illustrating the orientation of the exterior contacts.

FIG. 20 illustrates a standard extrusion 200 such as that shown in FIGS. 15 and 16. The links of the present invention may be terminated into connector and other housings. FIGS. 21–23 illustrate one termination interface as a somewhat conical endcap which has a hollow body 501 with a central openings 502. The body may support a pair of terminals 504 that mate with the conductive surfaces 52 of the dielectric body 51. The endcap 500 may be inserted into various openings in connector housings or circuit boards and as such, preferably includes a conical insertion end 510. The endcap 500 may be structured to terminate only a single transmission line as is illustrated in FIGS. 21–23, or it may be part of a multiple termination interface and terminate multiple distinct transmission lines as illustrated in FIGS. 24 and 25.

Figure 24:
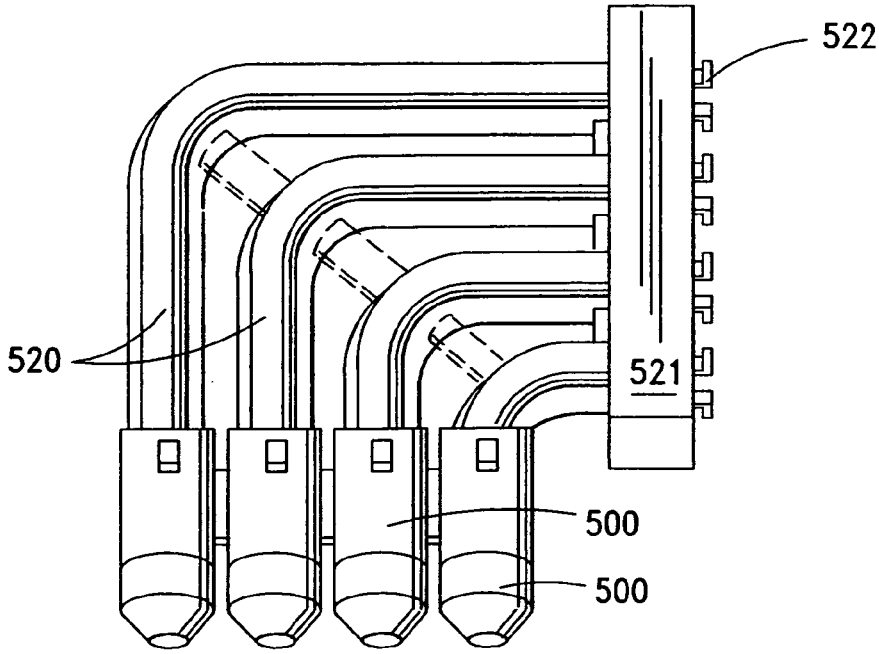
FIG. 24 is a plan view of a multiple transmission link right angle, curved connector assembly.

FIG. 24 illustrates the endcaps 500 in place on a series of links 520 that are terminated to an endblock 521 that has surface mount terminals 522 so that the endblock 521 may be attached to a circuit board (not shown). The endcap need not take the conical structure shown in the drawings, but may take other shapes and configurations similar to that shown and described below.

Figure 25:
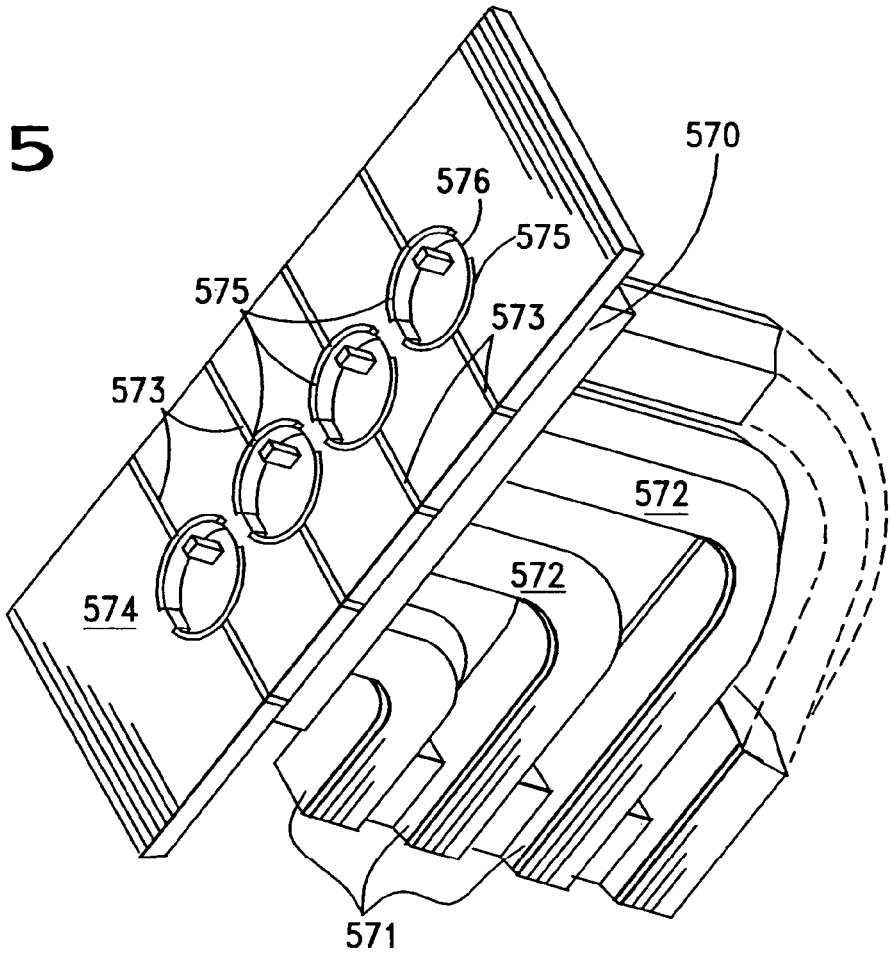
FIG. 25 is a perspective view of an alternate construction of one of the termination ends of the connector assembly.

FIG. 25 illustrates an alternate construction of an end block 570. In this arrangement, the transmission lines, or links 571, are formed from a dielectric and include a pair of conductive extents 572 formed on their exterior surfaces (with the extents 572 shown only on one side for clarity and their corresponding extents being formed on the surfaces of the links 571 that face into the plane of the paper of FIG. 25). These conductive extents 572 are connected to traces 573 on a circuit board 574 by way of conductive vias 575 formed on the interior of the circuit board 574. Such vias may also be constructed within the body of the end block 570, if desired. The vias 575 are preferably split as shown and their two conductive sections are separated by an intervening gap 576 to maintain separation of the two conductive transmission channels at the level of the board.

Figure 26:
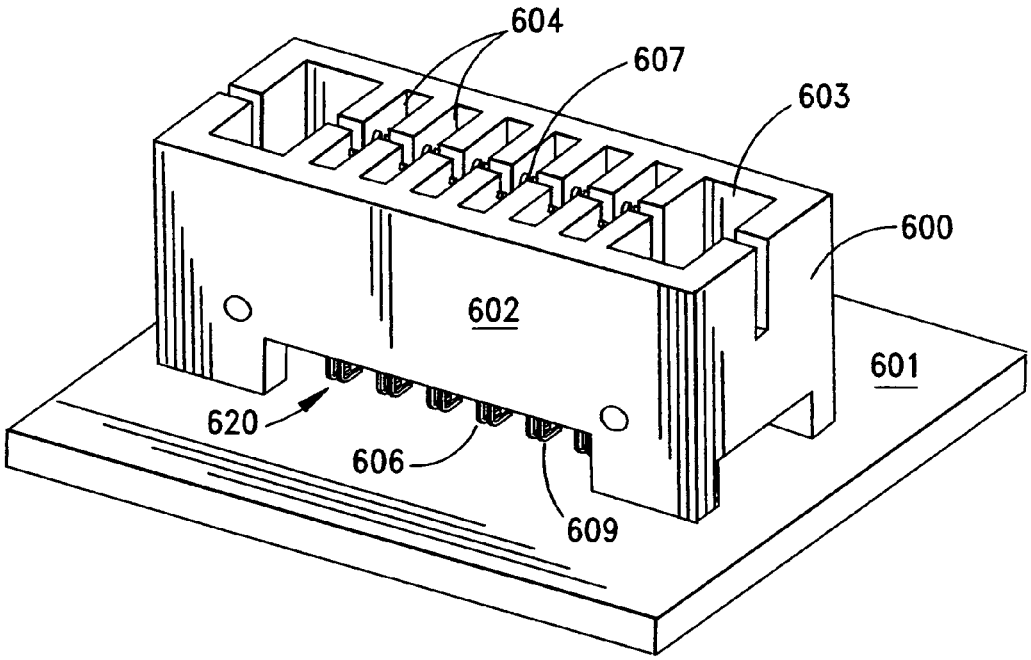
FIG. 26 is a perspective view of a connector suitable for use in connecting transmission channel links of the present invention to a circuit board.

FIG. 26 illustrates an endcap, or block 600 mounted to a printed circuit board 601. This style of endcap 600 serves as a connector and thus includes a housing 602, with a central slot 603 with various keyways 604 that accept projecting portions of the transmission link. The endcap connector 600 may have a plurality of windows 620 for access to soldering the conductive tail portions 606 of the contacts 607 to corresponding opposing traces on the circuit board 601. In instances of surface mount tails a shown, the tails 606 may have their horizontal parts 609 tucked under the body of the endcap housing to reduce the circuit board pad size needed, as well as the capacitance of the system at the circuit board.

Figure 27A:
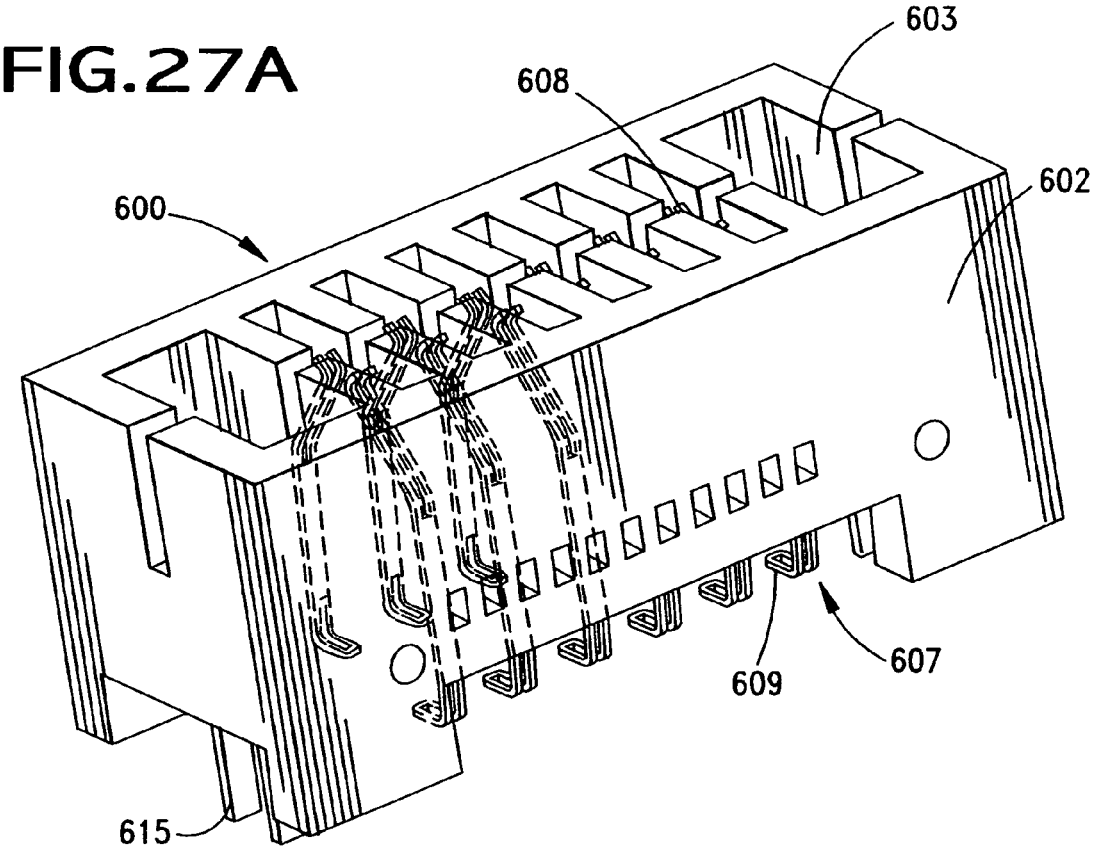
FIG. 27A is a skeletal perspective view of the connector of FIG. 26 illustrating, in phantom, some of the internal contacts of the connector.
Figure 27B:
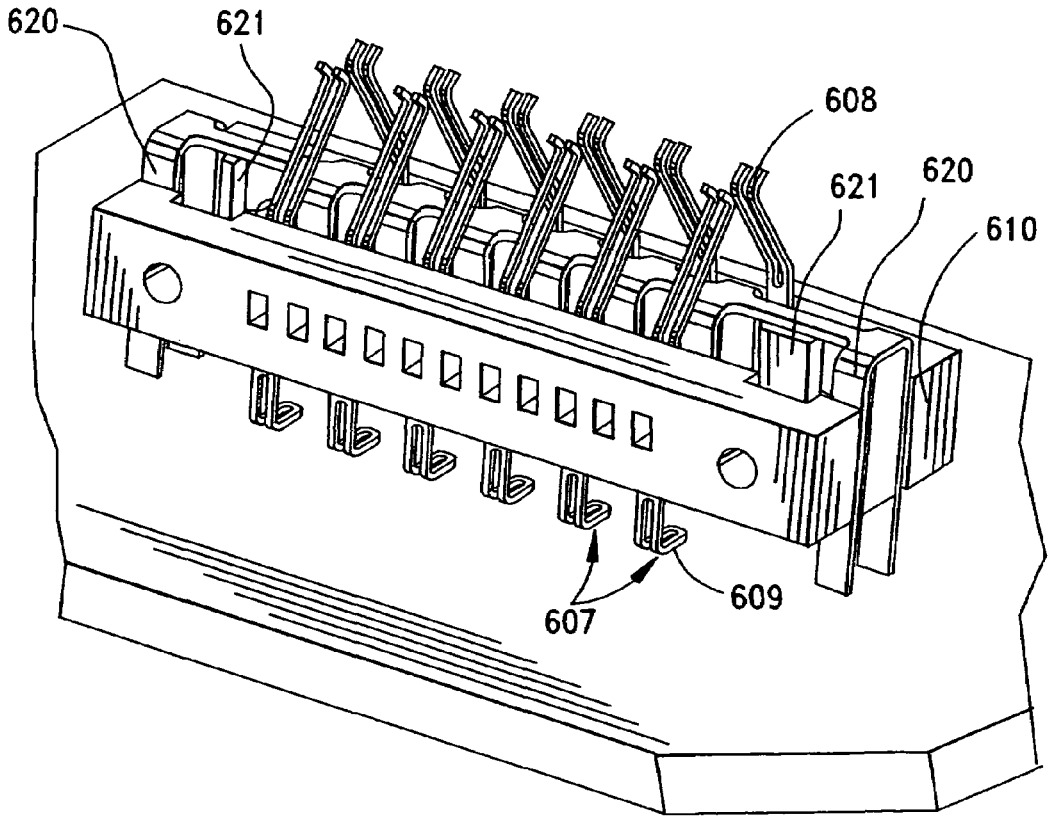
FIG. 27B is a perspective view of the interior contact assembly of the connector of FIG. 27A, with the sidewalls removed and illustrating the structure and placement of the coupling staple thereon.

FIG. 27A illustrates a partial skeletal view of the endcap connector 600 and shows how the contacts, or terminals 607 are supported within and extend through the connector housing 602. The terminals 607 may include a dual wire contact end 608 for redundancy in contact (and for providing a parallel electrical path) and the connector 600 may include a coupling staple 615 that has an inverted U-shape and which enhances coupling of the terminals across the housing. The coupling staple 615 can be seen to have an elongated backbone that extends lengthwise through the connector housing 602. A plurality of legs that are spaced apart from each other by spaces along the length of the coupling staple extend down toward the circuit board and each such leg has a width that is greater than a corresponding width of the terminal that it opposes. As shown in the drawings, the coupling staple legs are positioned in alignment with the terminals. The tail portions of these dual wire terminals 607 enhance the stability of the connector. In this regard, it also provides control for the terminals that constitute a channel (laterally) across the housing slot 601. The dual contact path not only provides for path redundancy but also reduces the inductance of the system through the terminals. FIG. 27B is a view of the interior contact assembly that is used in the endcap connector 600 of FIGS. 26 and 27A. The terminals 607 are-arranged on opposite sides of the connector and are mounted within respective support blocks 610. These support blocks 610 are spaced apart from each other a preselected distance that assists in spacing the terminal contacts 608 apart.

A conductive coupling staple 615 having an overall U-shape, or blade shape, may be provided and may be interposed between the terminals 607 and support blocks 610 to enhance the coupling between and among the terminals 607. The coupling staple 615 has a series of blades 620 that are spaced apart by intervening spaces 621 and which are interposed between pairs of opposing contacts (FIG. 28) 6087 and which extend downwardly toward the surface of the circuit board. The staple 615 extends lengthwise through the connector body between the connector blocks 610. The connector blocks 610 and the connector housing 602 (particularly the sidewalls thereof) may have openings 616 formed therein that receive engagement plugs 617 therein to hold the two members in registration with each other. Other means of attachment may be utilized, as well.

Figure 28:
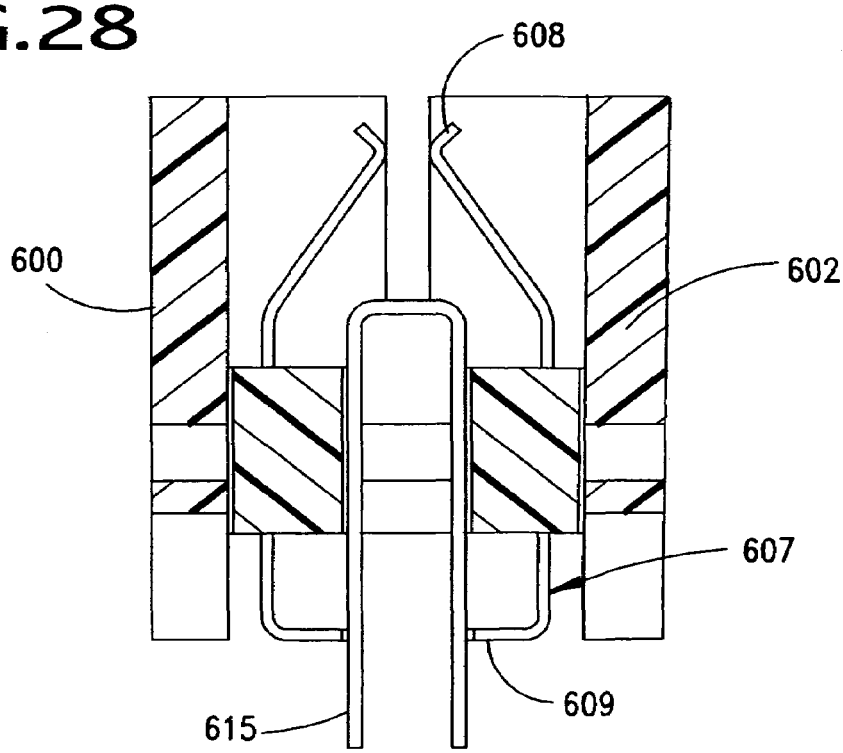
FIG. 28 is a cross-sectional view of the connector of FIG. 26, taken along lines 28—28 thereof.

FIG. 28 is an end view of the connector 600, which illustrates the interposition of the coupling staple between a pair of opposing contacts 608 and the engagement of the connector blocks 610 and the connector housing 602.

Notwithstanding all of the foregoing, FIG. 29 is a perspective view of one embodiment of a slot transmission line patch connector 10 that is capable of bridging (i.e., connecting or "patching") together two separate slot transmission segments, hence the designation "patch" connector. In FIG. 29, two separate slot transmission lines 12 and 14 formed in a dielectric substrate 36 are patched together by a slot transmission line 30 formed in the connector 10 to cross over a circuit board trace or other component 39 on the circuit board. Other embodiments of the slot transmission line disclosed hereafter allow one or more transmission lines to cross over spaces on a circuit board or between separate circuit boards.

As is well known, a signal propagating along a transmission line section will "see" an impedance that is a function of the transmission line's inductance and capacitance per unit length. ($Z=\sqrt{(LC)}$) Slot transmission lines are no different. Accordingly, the impedance of a slot transmission line is a function of the area of conductive material on the opposing side walls and the distance between them. Accordingly, the depth of the slot, the width of the slot and the metallization area of the slots side walls and any intervening dielectric(s) will determine the slot transmission line's impedance. As is well-known, impedance discontinuities along a transmission line can cause reflections of a wave that propagates along the transmission line. In addition, an abrupt change of the transmission line direction can cause wave reflections, in part because the spacing between conductors (with typically constructed structures) changes abruptly and non-uniformly.

In order to minimize wave reflections, yet allow separate transmission line sections to be patched together, the physical and electrical characteristics of the slot transmission line 30 in the patch connector 10 should match the characteristics of the transmission lines 12 and 14 as closely as possible. In at least one embodiment shown in FIGS. 36 and 38, curved or arcuate transmission line sections of unitary construction can be used to smoothly change the direction of transmission line sections to reduce wave reflections caused by abrupt line direction changes.

In order to bridge a space separating two wave guide sections 12 and 14, the patch connector 10 is made up of an elongated dielectric connector body 16 having first and second opposing ends 18 and 20. (The connector body "end" that is identified by reference numeral 18 is plainly visible in the perspective view provided in FIG. 29 whereas the opposing end 20 is not visible in FIG. 29.) The elongated dielectric connector body 16 has at least two opposing sides. The first of which is identified by reference numeral 22, the second of which is not readily seen in FIG. 29 but is identified by reference numeral 24. The two opposing sides 22, 24 extend between the first and second ends 18 and 20. A top surface, identified by reference numeral 26 and a bottom surface identified by reference numeral 27 lie between the two opposing sides 22 and 24 and between the first and second ends 18 and 20. Those of ordinary skill will recognize that a rectangular shaped connector body is relatively easy to manufacture but alternate embodiments would include using dielectric blocks having trapezoidal, square or even semi-circular cross sections. In the embodiments, disclosed herein, the dielectric connector body can be formed from almost any dielectric material.

A slot transmission line 30 is formed in the top surface 26 and ends 18 and 20 of the connector body 16 in accordance with the preceding sections whereby slot dimensions and slot sidewall metallization match the slot transmission line sections 12 and 14 coupled together. In the embodiment shown in FIG. 29, the slot transmission line 30 is formed in the dielectric connector body 16 so that the slot transmission line 30 extends around the first and second ends 18 and 20 so that the slot transmission line 30 terminates on the bottom surface 27 of the dielectric connector body 16. As shown in FIG. 29, the slot from which the transmission line 30 is formed is formed or cut through the dielectric body 16 and then coated with conductive material 46 so that the transmission line has a first "end" that terminates at the bottom surface 27, proximate to the first end 18 of the connector body 16. Reference numeral 32 denotes the first end of the slot transmission line 30.

A second end of the slot transmission line 30 is identified by reference numeral 34 and is proximate to, the second end 20 of the dielectric connector body 16. The second transmission line end 34 also terminates on the bottom surface 27 of the dielectric body 16.

As set forth above, the slot transmission line 30 is formed by a slot or groove having a substantially planar bottom 51 (shown in FIG. 30*b*) that separates first and second opposing sidewalls 48 and 49. Alternate and equivalent embodiments include slots that have bottoms that are non-planar. The opposing slot sidewalls are at least partially coated with a conductive material 46. In the embodiments presented herein, slot sidewalls are completely metallized for ease of illustration.

Conductive material 46 is applied to the opposing sidewalls 48 and 49 so that conductive material 46 at the first and second ends 32 and 34 of the slot transmission line 30 can make electrical contact with the corresponding sidewall conductive coatings in the first and second slot transmission lines 12 and 14 formed in the substrate 36. In so doing, a signal can propagate along either transmission line segment 12 or 14, through the slot transmission line 30 to the other slot transmission line segment 14 or 12. By varying the length 38 of the patch connector body 16, the spacing 38 between the first and second transmission line ends 32 and 34 can be varied as needed to bridge two slot transmission lines 12 and 14 that may be in one or more circuit boards such that a conductive trace 39 or a component on the upper surface on the circuit board 36 precludes running the transmission line segments 12 and 14 directly into each other.

Figure 30A:
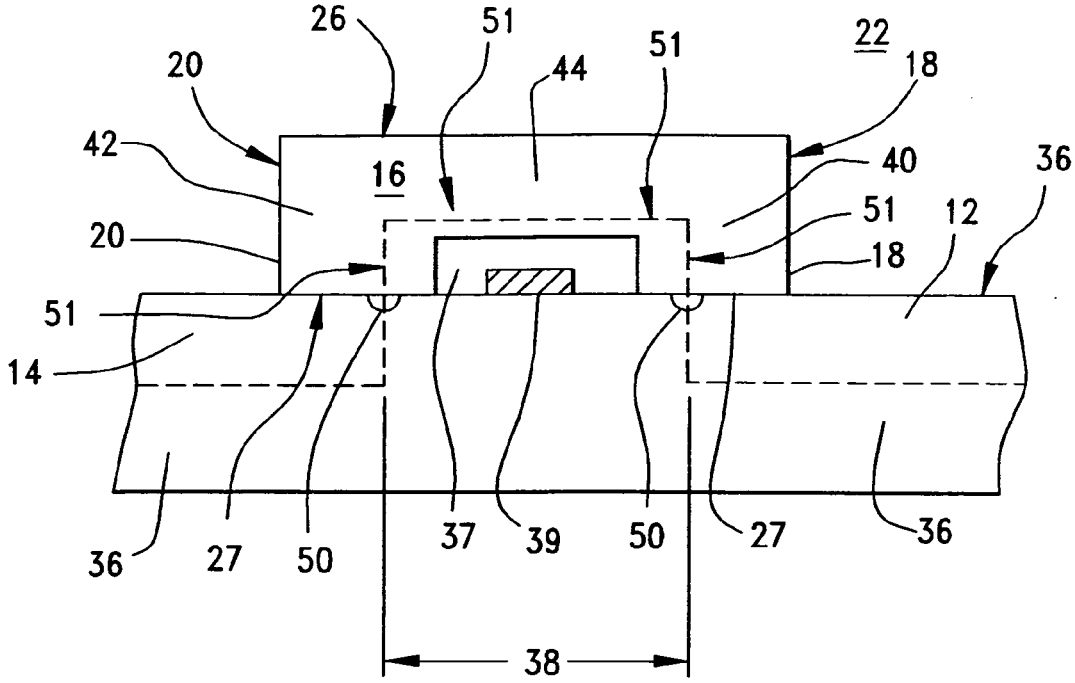
FIG. 30A is an end view of the connector of FIG. 30.
Figure 30B:
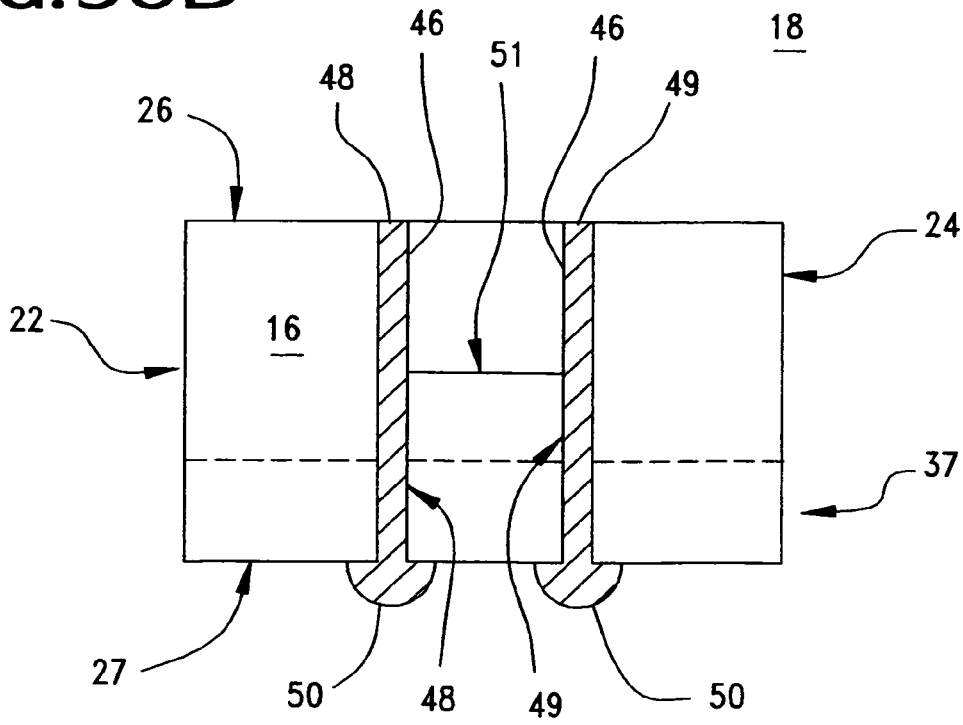
FIG. 30B is an end view of the connector body of the connector of FIG. 29.

FIG. 30A shows a side 22 of the connector 10 shown in FIG. 29. The first and second ends 18 and 20, top 26 and bottom 27 are depicted in FIG. 30A. The distance separating the first transmission line 12 and the second transmission line 14 is identified by reference numeral 38. It can be seen in FIG. 30A and 30B that the bottom 51 of the slot transmission line 30 extends downward to the bottom surface 27 of the connector body 16. Conductive material 46 coating the sides of the two slot transmission lines 12 and 14 matches and electrically contacts the conductive material 46 on the opposing sides 48 and 49 of the dielectric connector bodies 16. Accordingly, the conductive material 46 on the opposing sides 48 and 49 provide a segment of transmission line to bridge between the two transmission lines 12 and 14. A bridging section 37, which is shown in both FIG. 29 and FIG. 30A, is sized and shaped to allow the slot transmission line 30 in the dielectric connector body 16 to pass over a structure 39 such as a circuit board trace or component on the surface of the circuit board 36.

Electrical contact between the conductive material 46 on the opposing sidewalls 48 and 49 of the patch connector 10 and transmission lines in a circuit board is provided by way of electrical contact structures 50 that extend beyond the bottom 27. Solder balls and surface mount "tails" are but two known means that may be used as electrical contact structures 50 with the present invention.

In order to bridge (i.e., connect) two transmission lines 12 and 14 yet traverse a structure 39 on the surface of the circuit board 36 it is necessary to raise the transmission lines 12 and 14 above the highest point of the structure 39 on the circuit board 36 surface. Dimensions of the dielectric connector body 16 are selected so that the vertically-oriented first and second transmission line end sections 40 and 42 raise the slot transmission line horizontal section above the top of a structure 39 on the circuit board 36.

The first and second end sections 40 and 42 are shown as substantially orthogonal to the first and second transmission lines 12 and 14 (and orthogonal to the third section 44 of the transmission line 30) such that a signal propagating down the transmission lines 12 and 14 needs to abruptly change its direction when it encounters the patch connector 10 to travel upward. After the signal propagates along the end sections 40 and 42 it abruptly changes direction again to traverse the third section 44. Alternate embodiments of the invention include first and second end sections 40 and 42 that are curved or inclined with respect to the transmission lines 12 and 14 and with respect to the third section 44 by which transmission line discontinuities are reduced. When a signal propagates upward to the third transmission line slot section 44 it can pass over a structure 39, such as circuit board trace as shown in cross section in FIG. 30A and depicted isometrically in FIG. 29.

Figure 31:
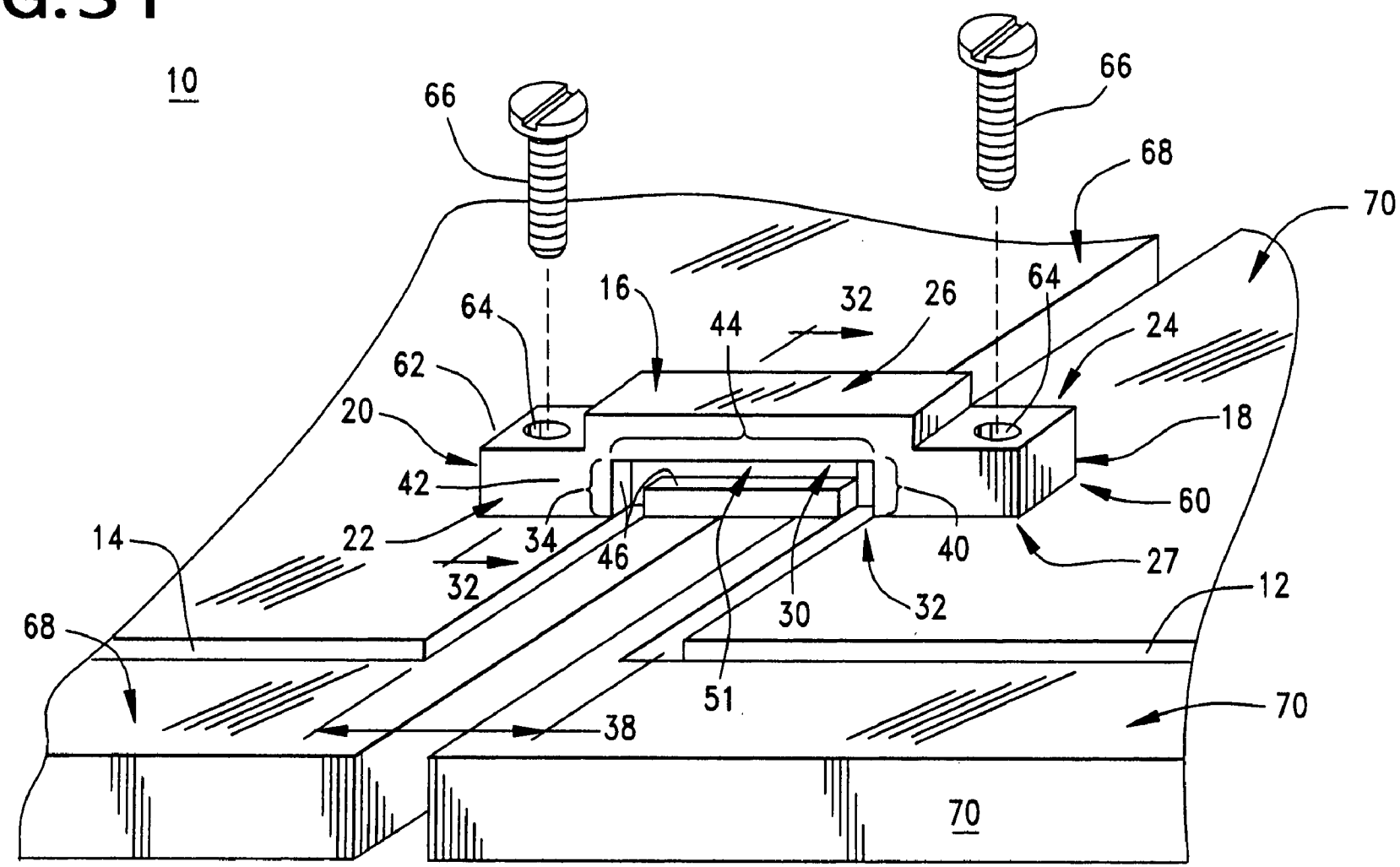
FIG. 31 is a perspective view of a slot transmission line patch connector constructed in accordance with the principles of the present invention.

FIG. 31 shows an alternate embodiment of a patch connector 10 capable of bridging slot transmission line segments. In FIG. 31, the patch connector 10 bridges slot transmission lines 12 and 14 that can lie in the same circuit board or in two different circuit boards 68 and 70. Like the embodiment shown in FIG. 29, the elongated dielectric connector body 16 has first and second opposing ends 18 and 20, first and second opposing sides 22 and 24, a top surface 26 and an opposing bottom surface 27.

In FIG. 31, the slot transmission line 30 is formed in the side 22 of the connector body 16 with opposing, metallized side walls separated by a substantially planar bottom 51. Like the embodiment shown in FIG. 29, the slot transmission line 30 formed in the side 22 has a first end 32, formed by a first transmission line end section 40 that is substantially orthogonal to both the first transmission line 12 in the substrate 70 and a third slot transmission line section 44 that is also formed in the side 22 of the connector body 16. The transmission line 30 has a second end 34 formed by a second transmission line end section 42 that is also substantially orthogonal to the transmission line 14 in the second circuit board 68. The dimensions of the slot sections 40, 42 and 44 substantially match the dimensions of the transmission lines 12 and 14 being bridged.

While the embodiment of the patch connector 10 shown in FIG. 29 is suitable for coupling transmission lines on the same circuit board, the embodiment of the patch connector 10 shown in FIG. 31 can also be used connecting slot transmission lines on separate circuit boards in that it also acts as a strain relief to keep two circuit boards 68 and 70 fixedly spaced apart by virtue of the two attachment structures 60 and 62. In FIG. 31 the dielectric connector body 16 is formed to have two attachment structures that are identified by reference numerals 60 and 62 and by which the two circuit boards 68 and 70 are maintained in a relatively fixed separation from each other.

The attachment structures 60 and 62 shown in the figures are simply extensions of the dielectric connector body 16, formed with through holes to permit the patch connector 10 to be securely attached to one or more circuit boards. The connector 10 can be affixed to circuit boards 68 and 70 by way of rivets, screws or pegs (identified by reference numeral 66), which are sized and shaped to extend through the holes 64 in the attachment structures 60. In so doing, the spacing between the substrates 68 and 70 can be maintained by way of the tensile strength of the dielectric connector body 16.

Figure 32:
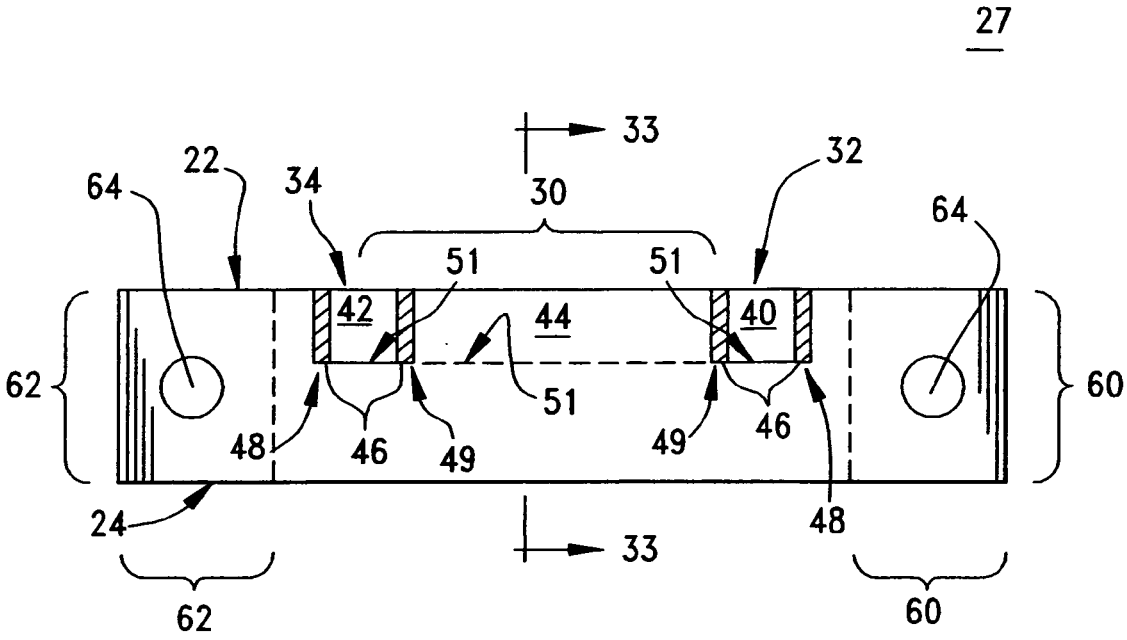
FIG. 32 is sectional view of the connector of FIG. 31, taken along lines 32—32 thereof.

FIG. 32 is a bottom view of the connector dielectric body 16 shown in FIG. 31. The slot transmission line 30 formed in the side 22 terminates in the bottom surface 27. FIG. 32 shows the conductive coating 46 that is applied to the opposing sides 48 and 49 of the slot sections 40 and 42. As shown in both FIG. 31 and FIG. 32, the attachment structures 60 and 62 are extensions of the dielectric connector body 16 that are stepped or cut so that tops of the fasteners 66 that extend through the holes 64 are kept below the top 26 of the connector body 16.

Figure 33:
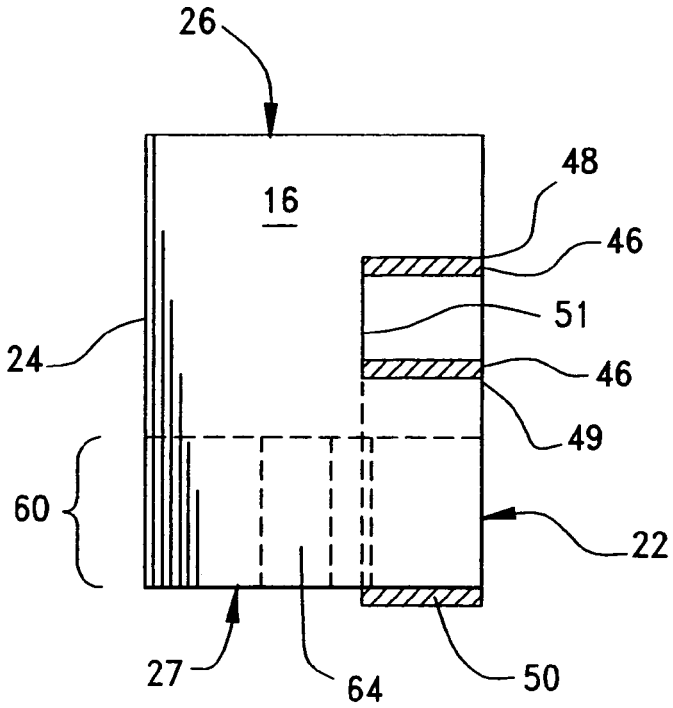
FIG. 33 is a sectional view of FIG. 32, taken along lines 33—33 thereof.

FIG. 33 is a view of the patch connector shown in FIG. 31 albeit through section lines AA that are shown in FIG. 32. In FIG. 33, the slot transmission line bottom 51 is shown as being vertical and parallel to the opposing sides 22 and 24 of the connector body 16. The opposing sidewalls 48 and 49 of the slot through the connector body 16 and their conductive coatings 46 are clearly shown as parallel to the top 26 and bottom 27 surfaces. FIG. 33 also shows an electrical contact structure 50 by which signals are coupled into the slot transmission line 30 in the connector body 16 from at least one of the transmission lines 12 and 14 being coupled. In FIG. 33, the contact structure is a metalization tab or strip 50 extending below the bottom 27 of the dielectric bottom 16 so that it can electrically contact side wall metallization of the transmission lines 12 or 14.

The connection structure 50 could be a surface mount tail which is an extension of the metal coating 46 on each side 48 and 49 so that the tail extends below the bottom 27 and into contact with conductive material coating the sides of an opposing transmission line 12 or 14. Alternative embodiments would include using a solder ball as a contact structure.

The attachment structures 60 and 62 that attached the connector body 16 to circuit boards 68 and 70 are depicted in FIGS. 31 and 32 as being extensions or bosses that extend away from the connector body 16 wherein the slot transmission line 30 is formed. The attachment structures 60 and 62 shown in FIGS. 31 and 32 are formed to have holes 64 through which a fastener such as a screw, rivet or post can be extended and into a circuit board so that two such boards can be fixed relative to each other.

Figure 34:
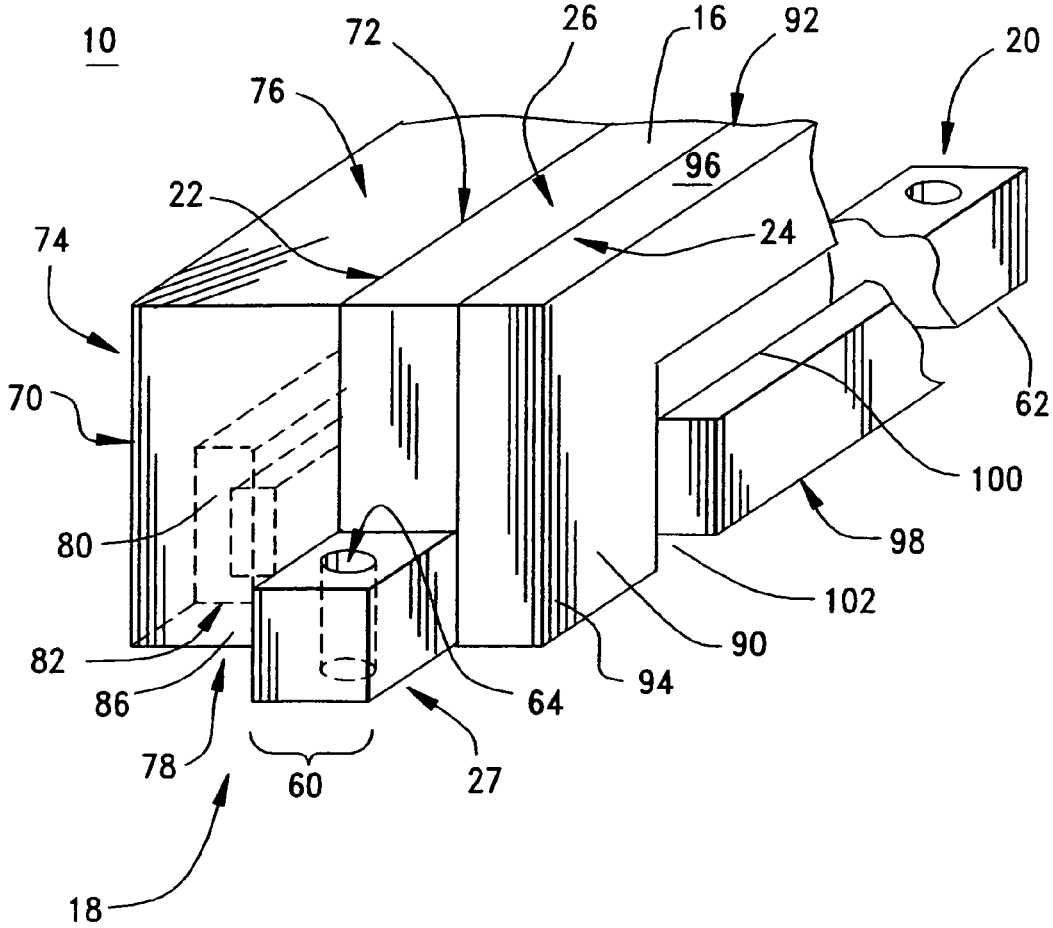
FIG. 34 is a perspective view of another embodiment of a patch connector of the present invention.

FIG. 34 shows yet another embodiment of a patch connector capable of bridging slot transmission lines. In the embodiment shown in FIG. 34, the elongated dielectric connector body 16 is sandwiched between two separate slot-transmission-line substrates 70 and 90 that are each made up of dielectric material and that each carry their own slot transmission line through them. Because each of the slot transmission line substrates 70 and 90 carry a slot transmission line, the connector 10 shown in FIG. 34 is capable of bridging at least two slot transmission lines, which might be in the same circuit board or which might be in first and second adjacent circuit boards. Unlike the elongated dielectric bodies shown in FIGS. 29–33, the elongated dielectric connector body 16 in FIG. 34 has first and second opposing sides 22 and 24 that can optionally be metal coated. (The metal coating of the exterior surfaces of the dielectric connector body 16 is not readily shown in the figures. Those of ordinary skill in the art will recognize that if a side 22 or 24 is not metallized, the mating side of the slot transmission line substrate could be metallized instead. An embodiment where a side of transmission line substrate 70 and/or 90 adjacent an non-metallized side 22 or 24 of the connector body 16 is equivalent to a connector body 16 having all of its exterior sides metallized.)

By grounding the metal coating, it provides a ground plane or shield by which signals carried in each of the substrates 70 and 90 can be isolated from each other. In a preferred embodiment of the patch connector shown in FIG. 34, the top 26 surface, the bottom surface 27, and the first and second ends 18 and 20 are also metal coated and in electrical contact with metal coating on the sides 22 and 24 and coupled to a ground or other reference potential.

In FIG. 34, the first slot transmission line substrate 70 is glued, welded or soldered to the metal coated first side 22 of the connector body 16 such that the metal coating provides a ground plane with respect to the slot transmission line 80 formed in the substrate 70. The first slot transmission line substrate 70 therefore has its own first side 72, which is adjacent to and mechanically and electrically coupled to the metal coating on the first side 22 of the connector body 16. A second side 74 of the slot transmission line substrate 70 is parallel to and opposing the first side 72. A top 76 and a bottom 78 of the first slot transmission line substrate 70 extend between a first end 18 and a second end 20 of the connector 10.

A first slot transmission line 80 is formed in the first slot transmission line substrate 70 by a slot formed in the substrate but this first slot transmission line 80 is not readily shown in FIG. 34 because the figure is an isometric view. The first slot transmission line 80 formed in the first slot transmission line substrate 70 is substantially the same as the second slot transmission line 100, which is visible in FIG. 34 as is shown as formed in the second slot transmission line substrate 90. It can be seen in FIG. 34 that the second slot transmission line 100 has opposing side walls spaced apart from each other by a slot bottom.

Figure 35:
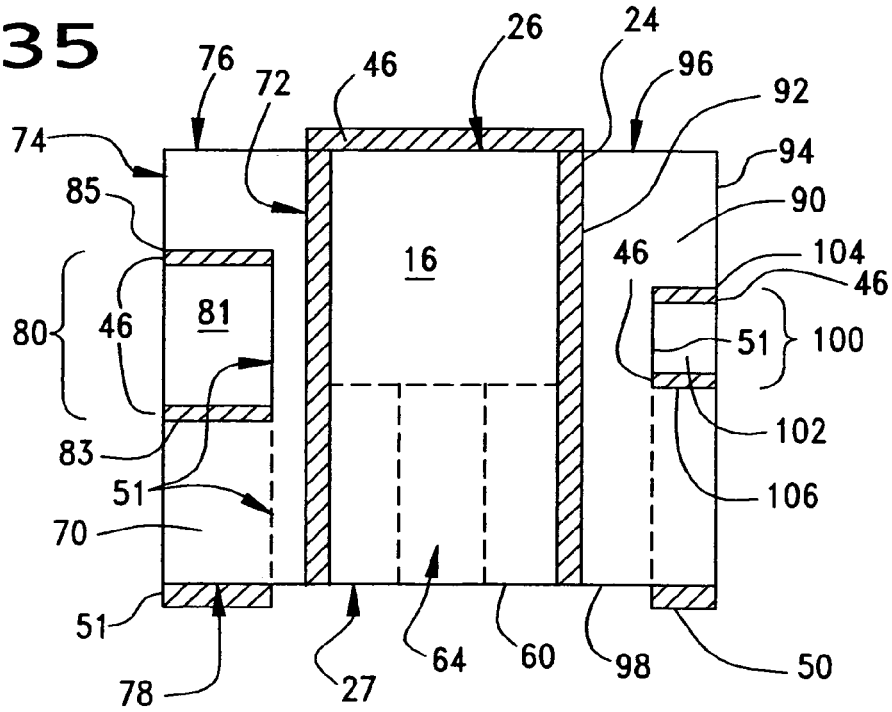
FIG. 35 is a sectional view of the connector of FIG. 34.

FIG. 35 is an elevation view through the middle of the patch connector 10 shown in FIG. 34 and shows features of the patch connector embodiment of FIG. 34 more clearly. FIG. 35 clearly shows the optional layer of conductive material 46, which when applied to the exterior surfaces of the dielectric connector body 16, provides a shield between signals on the transmission lines carried through the opposing substrates 70 and 90.

In FIG. 35, reference numeral 81 identifies the slot in the substrate 70 from which the first slot transmission line 80 is formed. The slot 81 has a substantially planar bottom 51 between its opposing sides 83 and 85. A metal surface or layer 46 is applied to each of the opposing sides 83 and 85. It can be seen that the slot 81 is formed in the second surface 74. A contact or connection structure 50 for each of the opposing sidewalls 83 and 85 extends below the bottom surface 78 of the first transmission line substrate 70. The contact structure 50 enables a direct electrical connection between the conductive material 46 coating the opposing sides 83 and 85 and corresponding opposing sidewalls of a transmission line in a circuit board.

Still referring to FIG. 35, a second slot transmission line substrate 90 is attached to the metal-coated second side 24 of the connector body 16. The second slot transmission line substrate 90 has its own first and second ends, which are not readily seen in FIG. 35. The second slot transmission line substrate 90 has a top surface 96, a bottom surface 98, a first side 92 that is adjacent to and in contact with the metal coating or conductive material 46 on the side 24 of the dielectric connector body 16. The second slot transmission line substrate 90 also has a second slot transmission line 100 formed by a slot 102 in the second side 94 of the second substrate 90.

Like the slot transmission lines described above, the second slot transmission line 100 in the second substrate 90 has opposing side walls 104 and 106 that have a conductive material 46 applied to each of them. A planar bottom 51 separates the opposing sides 104 and 106.

In FIG. 35, the separation distance between the first and second opposing sidewalls 83 and 85 of the first slot transmission line 80 is greater than the separation distance between the opposing side walls 104 and 106 of the second slot transmission line 100. The different wall spacings will provide different impedances between the two slot transmission lines 80 and 100. FIG. 5 therefore shows that the electrical characteristics of the slot transmission lines 80 and 100 can be modified to bridge slot transmission lines with different electrical and physical characteristics.

Figure 36:
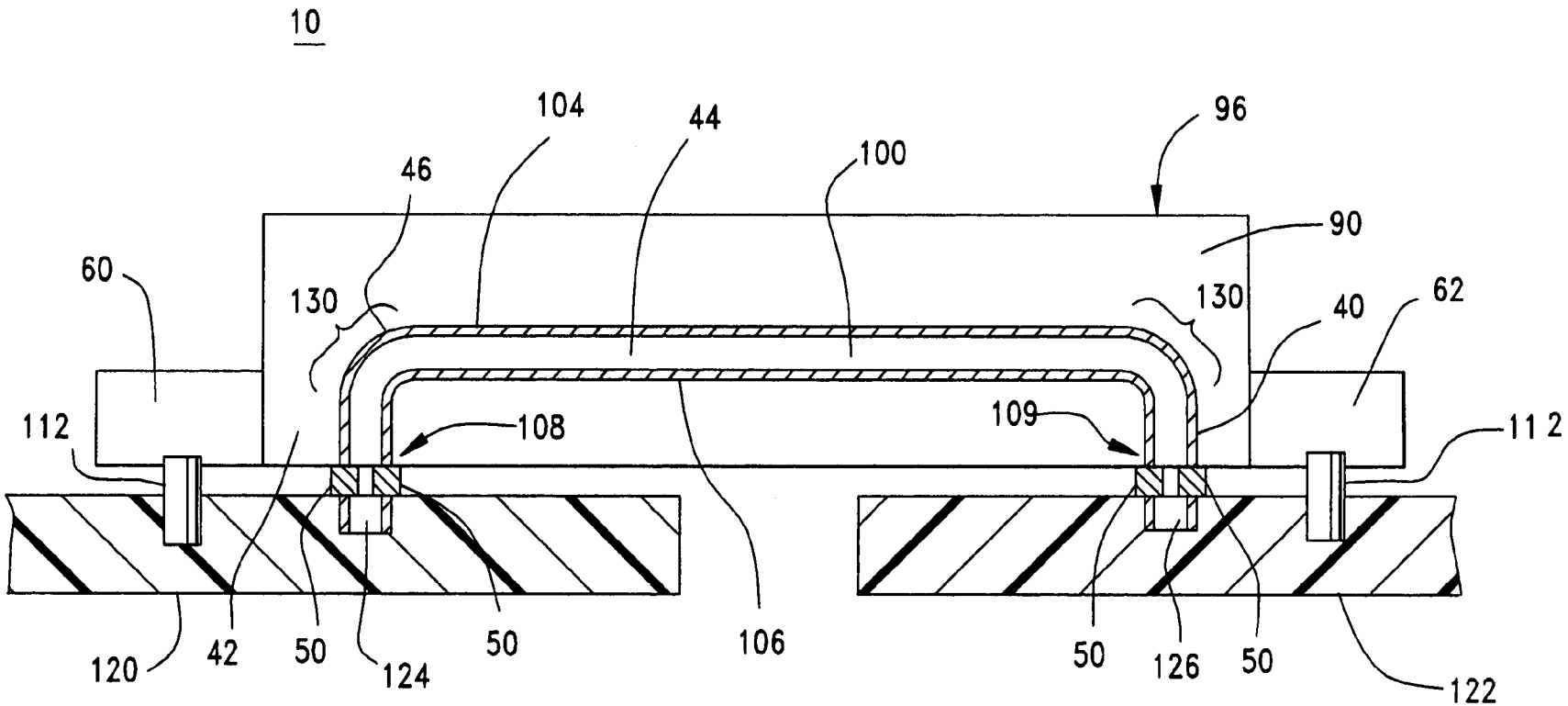
FIG. 36 is a side sectional view of a patch connector of the invention.

FIG. 36 shows a side view of the connector body shown in FIGS. 34 and 35 and another embodiment of a slot transmission line patch connector. In the embodiment shown in FIG. 36, the first and second transmission line "end sections" 40 and 42 are joined to the third slot section 44 by way of arcuate transmission line sections 130. By using arcuate transmission line sections 130 to join the orthogonal transmission line sections, the sharp orthogonal comers as depicted in FIGS. 29, 31 and 35 can be eliminated, at least reducing the tendency of such corners to cause wave reflections.

In addition to showing arcuate transitions sections 130, FIG. 36 shows the attachment structures 60 and 62 of the patch connector 10 fixed to the circuit boards 120 and 122 by attachment posts 112. The attachment posts 112 can be sized and shaped to extend into holes or recesses in the attachment structures 60 and 62, as well as the circuit boards 120 and 122.

FIG. 36 also shows the placement of the contact structures 50 between the bottom surface 27 of the patch connector 10 and the circuit boards 120 and 122. The attachment structures 50 electrically couple each end of the transmission line 100 to the conductive material 46 on the opposing sidewalls of slot transmission lines 124 and 126 in the respective circuit boards 120 and 122.

Figure 37:
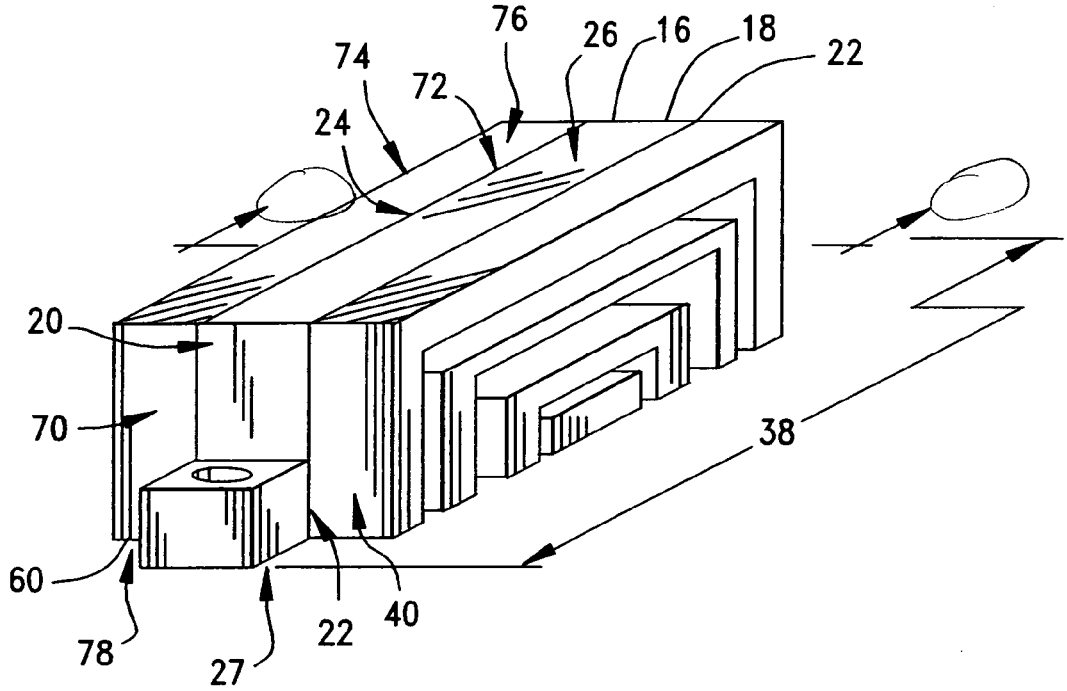
FIG. 37 is a perspective view of another embodiment of a patch connector of the present invention.

FIG. 37 shows an isometric view of another embodiment of a patch connector 10 capable of bridging a plurality of slot transmission lines on the same circuit board or on separate, first and second circuit boards. In FIG. 37, the elongated dielectric connector body 16 is sandwiched between two slot transmission line dielectric substrates 70 and 90 that are each made up of dielectric material and that each carry multiple slot transmission lines. The first transmission line substrate 70, which is shown on the "left" side of the connector body 16, is electrically and mechanically coupled to the first side 22 of the connector body 16. This first substrate 70 also has a first side 72 adjacent to and coupled to the first side 22 of the connector body 16. In addition to having a first side 72 adjacent the connector body, 16, the first substrate 70 has an opposing second side 74 through which multiple slot transmission lines are formed but which are not visible in FIG. 37.

As with the embodiment shown in FIGS. 34, 35 and 36, the dielectric connector body 16 of the embodiment shown in FIG. 37 can optionally have its exterior surfaces coated with a conductive material. When such a coating is provided and coupled to a ground potential, it will isolate signals carried on one substrate 70 or 90 from signals carried on the other substrate 90 or 70.

Figure 38:
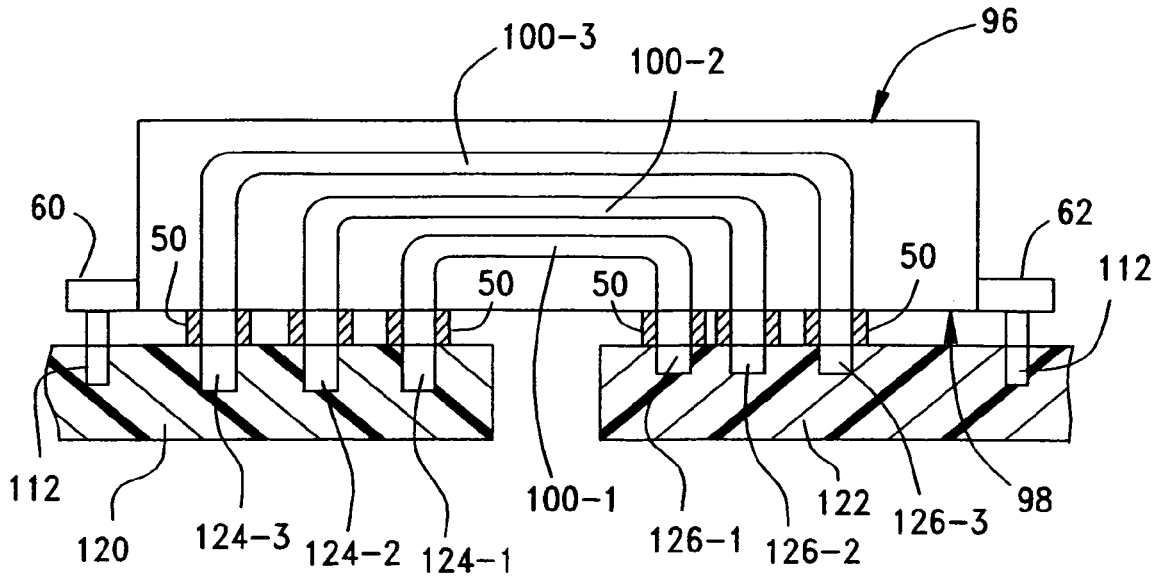
FIG. 38 is an elevational side view of the connector of FIG. 34*g* directly at side 94 thereof.

FIG. 38 shows an elevation view of the side 94 of the second slot transmission line substrate 90 depicted in FIG. 37. In this figure it can be seen that the connector 10 bridges three separate slot transmission lines 124-1, 124-2 and 124-3 in one circuit board 120 to three, corresponding transmission lines 126-1, 126-2 and 126-3 in a separate but adjacent circuit board 122. Those of skill in the art will recognize that the slot transmission lines 124-1, 124-2 and 124-3 and 126-1, 126-2 and 126-3 could also be in the same circuit board with the distance between them being limited only by the length of the dielectric body 16 and the length of the transmission line substrate 90.

As shown in FIG. 38, each of the slot transmission lines 100-1, 100-2 and 100-3 has a different physical length and a different electrical length due to the fact that the multiple transmission lines are formed to be parallel to each other in the same planar transmission line substrate 90. Moreover, each transmission, 100-1, 100-2 and 100-3 has its orthogonal sections joined by arcuate bends in order to minimize reflected waves that might otherwise be caused by sharp orthogonal junctions, such as those depicted in FIG. 31.

In particular, the first transmission line, 100-1 has a physical length and an electrical length shorter than the second transmission line 100-2. Similarly, the second transmission line 100-2 is electrically and physically shorter than the third slot transmission line 100-3.

In addition to bridging slot transmission lines in separate circuit boards 120 and 122, the patch connector shown in FIG. 38 can provide act as a strain relief by the attachment structures 60 and 62 when they are joined to the circuit boards 120 and 122. Screws, rivets or attachment posts are all equivalent means by which any of the patch connectors depicted herein can be attached to one or more circuit boards.

Like the other foregoing embodiments, conductive material 46 applied to the opposing side walls of the different transmission lines 100-1, 100-2 and 100-3 extends below the bottom surface of the substrate by way of contact structures 50.

Figure 39:
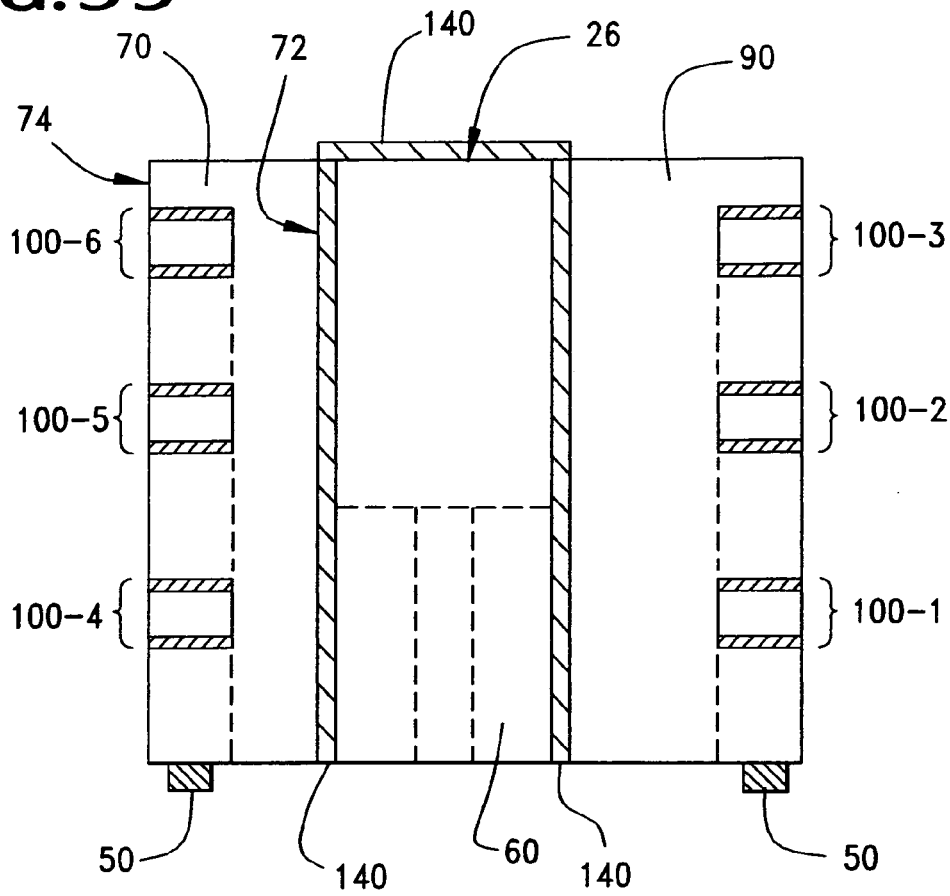
FIG. 39 is sectional view of the connector of FIG. 38.

FIG. 39 is a sectional view of the structure shown in FIG. 38 showing the end views of six different slot transmission lines 100-1 through 100-6. Metal coating on the dielectric connector body 16 is identified by reference numeral 140. It isolates signals carried in the first substrate 70 from signals carried in the second substrate 90. Contact structures 50 by which signals are coupled from the slot transmission lines 100-1–100-6 are also shown.

For the patch connector embodiments having slot transmission lines formed in the sides of a slot transmission line substrate attached to the connector body 16, a preferred embodiment contemplates the slot transmission lines being formed in the exterior surfaces of the substrates, i.e., the surfaces that face away from the dielectric connector body 16. Alternate embodiments however include forming the slot transmission lines in surfaces of the substrates 70 and 90 that face the dielectric connector body 16. In such an embodiment, the metalization on the opposing side walls of the slots would need to be kept away from contacting metallization on the exterior surfaces of the dielectric connector body 16. In addition however, the entire exterior surface of the slot transmission line substrates can be metallized to more fully shield the transmission lines. Such a structure is not readily depicted in the figures, but its construction should be understood by those of ordinary skill in the art.

Figure 40:
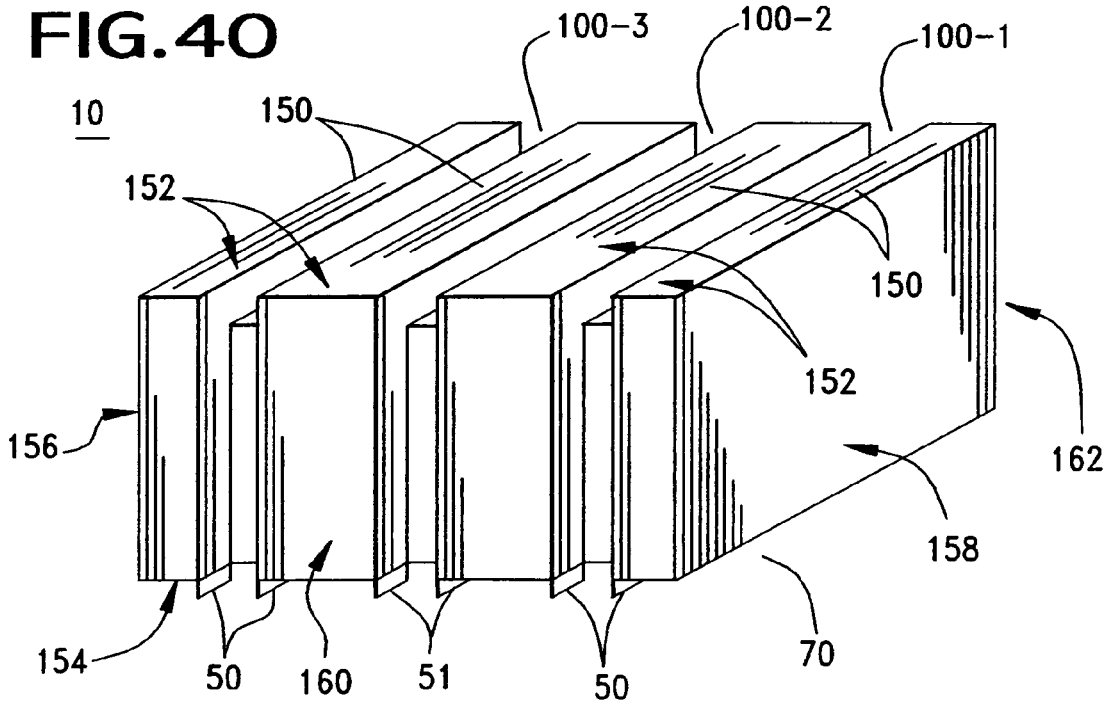
FIG. 40 is a perspective view of another patch connector constructed in accordance with the principles of the present invention.

FIG. 40 shows yet another embodiment of a patch connector that is capable of bridging several slot transmission lines on a single circuit board or bridging several slot transmission lines on two separate circuit boards. In this figure, three slot transmission lines 100-1, 100-2 and 100-3 are formed in the exterior surfaces of a first slot transmission line substrate 70 which has a top surface 152, a bottom surface 154, opposing side surfaces 156 and 158 and opposing first and second ends 160 and 162. As with the foregoing embodiments, the conductive material on the opposing sides of the slot transmission lines 100-1, 100-2 and 100-3 is electrically coupled to conductive material on the opposing sides of transmission lines in circuit boards by way of contact structures 50 that extend below the bottom 154 of the first transmission line substrate. These contact structures make electrical contact with conductive material on the opposing sidewalls of slot transmission lines in a circuit board.

Figure 41A:
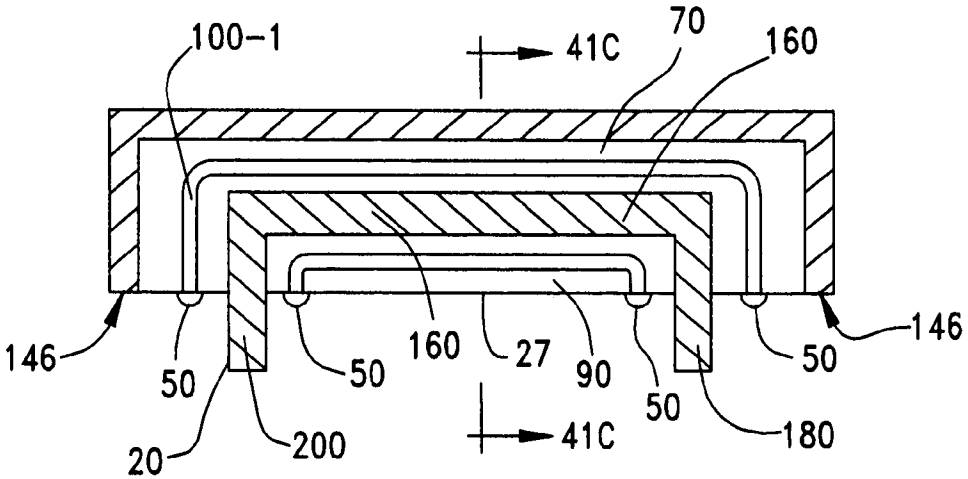
FIG. 41A is a side cross-sectional view of the connector of FIG. 40.

Not shown in FIG. 40 is the dielectric connector body, which is surrounded on three sides by the slot transmission line substrate 70 shown in the figure but which is shown in FIG. 41A. FIG. 41A is a side cross-sectional view of the structure shown in FIG. 40. In this figure, the dielectric connector body 16 lies between the first slot transmission line substrate 70 show in FIG. 40 and the second slot transmission line substrate 90, which lies beneath or inside the dielectric connector body 16. First and second transmission line end sections 180 and 200 are shown as being substantially orthogonal to the transmission line middle section 160. These end sections 180 and 200 are to have posts 121 and 123 that extend into a circuit board whereby the connector can also act as a strain relief. An optional ground coating or shield 146 can be mounted over the exterior surfaces of the first substrate 70.

Figure 41B:
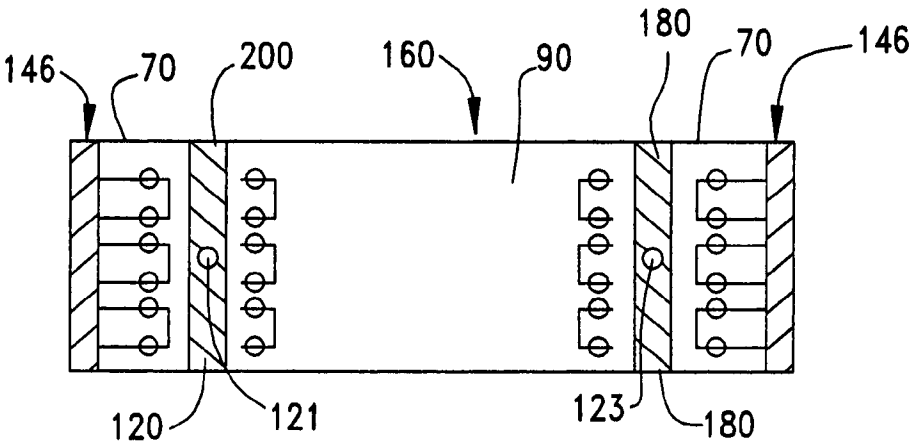
FIG. 41B is a bottom plan view of the FIG. 41A.
Figure 41C:
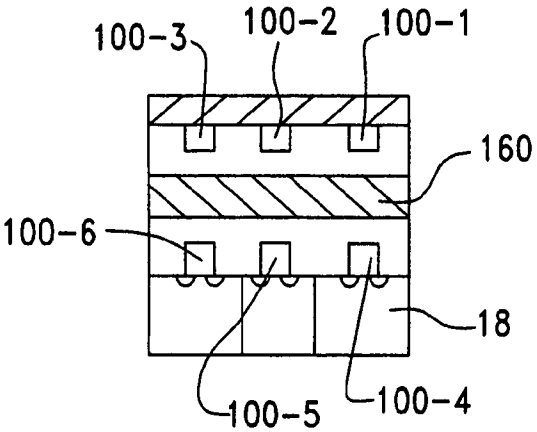
FIG. 41C is a sectional view of FIG. 41A, taken along lines 41C—41C thereof.

FIG. 41B shows a bottom view of the patch connector shown in FIG. 40 and 41A. In this figure, the ends of the six separate slot transmission lines carried by the two slot transmission line substrates 70 and 90 are separated by the dielectric connector body end sections 180 and 200. FIG. 41C is a section view of the patch connector of FIG. 40 and 41 A, albeit along section lines C—C. In FIG. 41C, the second slot transmission line substrate 90 lies below the connector body 160 and has three slot transmission lines 100-4, 100-5 and 100-6 formed in its lower surface, which is away from the bottom surface of the dielectric body 160. Each of these slot transmission lines have ends that terminate at the bottom surface 27 of the patch connector. Contact structures 50 enable electrical signals to be coupled into and out of the slot transmission lines from slot transmission lines on circuit boards that the connector is to bridge.

It should be apparent from all of the foregoing that one or more slot transmission lines can be formed into a dielectric connector body that is sized and shaped to permit two or more separate transmission line sections to be bridged together. By selecting the length of the connector body and by selecting the length of slot transmission line substrates, slot transmission lines separated by virtually any distance can be joined together.

By smoothing the transmission between vertically-oriented transmission line section and horizontally-oriented transmission line sections, discontinuities along the length of the slot transmission lines formed in the connector bodies can be eliminated or reduced. By using connector body material with a high tensile strength and by attaching the connector body to separate circuit boards, the patch connector can also perform the function of a strain relief that holds two circuit boards in fixed relation to each other.

While the preferred embodiment of the invention have been shown and described, it will be apparent to those skilled in the art that changes and modifications may be made therein without departing from the spirit of the invention, the scope of which is defined by the appended claims.

The invention claimed is:

1. A patch connector, capable of bridging slot transmission lines comprising:

an elongated dielectric connector body having first and second opposing ends, opposing sides extending between said first and second ends, a top surface and an opposing bottom surface between said opposing sides and between said first and second ends; and, a first slot transmission line formed in at least one of said top and side surfaces, said first slot transmission line having a first end that terminates on said bottom surface proximate to said first end of said connector body, said first slot transmission line having a second end that terminates on said bottom surface proximate to said second end of said connector body, said first and second ends of said slot transmission line capable of being electrically coupled to corresponding transmission lines in at least one substrate to which said connector body is attached, the distance between the first and second ends of the first slot transmission line being substantially equal to the distance separating two separate slot transmission lines in said at least one substrate.

2. The connector of claim 1, wherein said first slot transmission line comprises first, second and third slot sections, each of said slot sections having first and second opposing surfaces that are coated with a conductive material and a slot bottom between said first and second opposing surfaces, a first end of said first slot section corresponding to the first end of said slot transmission line, a first end of said second slot section corresponding to the second end of said slot transmission line, said first and second slot sections being formed in said side to be oriented substantially orthogonal to said bottom surface of said connector body, the third slot section extending between the second ends of said first and second slot sections.

3. The connector of claim 2, wherein said first ends of said first and second slot sections have electrical contact structures that extend past the bottom surface of said connector body and which provide electrical contacts to the conductive material coating said first and second opposing surfaces.

4. The connector of claim 2, wherein said bottom includes a bridging section.

5. A patch connector, capable of bridging first and second slot transmission lines comprising:

an elongated dielectric connector body having: first and second opposing ends separated by a length L; first and second opposing sides that extend between said first and second ends; a top surface and a bottom between said first and second opposing sides and between said first and second ends; said elongated connector body having a first circuit board attachment structure proximate to said first end and having a second circuit board attachment structure proximate to said second end; and, a first slot transmission line formed in said first side, said first slot transmission line being comprised of a slot in said first side, the sides of said slot each having a conductive coating material that form opposing conductors of said first slot transmission line, said first slot transmission line having a first end that terminates on said bottom proximate to said first end of said connector body, said first slot transmission line having a second end that terminates on said bottom surface, proximate to said second end of said connector body, said length L and said first slot transmission line being of a length sufficient to extend between a slot transmission line on a first circuit board and a slot transmission line on a second circuit board.

6. The connector of claim 5, wherein said first and second attachment structures include:

a hole extending through a boss formed as part of said dielectric body and capable of accepting fasteners there through; and, an attachment post, integrally formed with the elongated dielectric connector body and extending from said bottom of said connector.

7. The connector of claim 5, wherein said connector body and said first and second attachment structures comprise a strain relief between said first and second circuit boards.

8. The connector of claim 5, further including first and second transmission line electrical connection structures on the bottom of said dielectric connector body at said first and second ends of said first slot transmission line, said electrical connection structures extending the conductors of said first slot transmission line to corresponding conductors on said first and second circuit boards.

9. The connector of claim 8, wherein said connection structures are at least one of: surface mount tails, extending from conductors of said first slot transmission line; and solder balls.

10. A patch connector, capable of bridging a plurality of slot transmission lines comprising:

an elongated dielectric connector body having: first and second opposing ends separated by a length L;

first and second metal-coated opposing sides that extend between said first and second ends; a top surface and a bottom between said opposing sides and first and second ends; said elongated connector body having a first circuit board attachment structure proximate to said first end and having a second circuit board attachment structure proximate to said second end;

a first slot transmission line substrate coupled to the metal coated first side of said connector body, said first slot transmission line substrate including a first side adjacent to and coupled to the first side of said connector body, a second surface opposing its first side, a top and a bottom;

the bottom of said first slot transmission line substrate being substantially coplanar with the bottom of said connector body, said first slot transmission line substrate having a first slot transmission line formed by a slot in a side of said first transmission line substrate, the sides of said slot being coated with conductive material that form opposing conductors of said first slot transmission line, said first slot transmission line having a first end that terminates on the bottom of said first slot transmission line substrate proximate to said first end of said connector body, said first slot transmission line having a second end that terminates on said bottom of said first slot transmission line substrate proximate to said second end of said connector body, said length L and said first slot transmission line being of a length sufficient to extend between slot transmission lines on said first and second circuit boards; and, a second slot transmission line substrate coupled to the metal coated second side of said connector body, said second slot transmission line substrate including a first side adjacent and coupled to the second side of said connector body, a second surface opposing its first side, a top and a bottom, the bottom of said second slot transmission line substrate being substantially coplanar with the bottom of said connector body, said second slot transmission line substrate having a second slot transmission line formed by a slot in a side of said second slot transmission line substrate, the sides of said slot being coated with conductive material that form opposing conductors of said second slot transmission line, said second slot transmission line having a first end that terminates on the bottom of said first slot transmission line substrate proximate to said first end of said connector body, said second slot transmission line having a second end that terminates on said bottom of said second slot transmission line substrate proximate to said second end of said connector body, said length L and said second slot transmission line being of a length sufficient to extend between slot transmission lines on said first and second circuit boards.

11. The connector of claim 10, wherein said first and second attachment structures include at least one of: an attachment post, integrally formed with the elongated dielectric connector body and extending from said bottom of said connector, and a hole extending through said dielectric body and capable of accepting fasteners therethrough.

12. The connector of claim 10, wherein said first slot transmission line is formed in the second surface of said first transmission line substrate and the second slot transmission line is formed in the second surface of said second transmission line substrate.

13. The connector of claim 10, further including transmission line electrical connection structures on the bottom of said dielectric connector body at the first and second ends of said first and second slot transmission lines, said electrical connection structures extending the conductors of said slot transmission lines to corresponding conductors on said first and second circuit boards.

14. The connector of claim 13 wherein said connection structures at least include one of: surface mount tails extending from conductors of said slot transmission lines, or solder balls.

* * * * *